US008699931B2

(12) United States Patent
Nanjo

(10) Patent No.: US 8,699,931 B2
(45) Date of Patent: Apr. 15, 2014

(54) FIXING DEVICE INCLUDING MOVABLE FRAME BODY AND IMAGE FORMING APPARATUS INCLUDING THE SAME

(75) Inventor: Yuzuru Nanjo, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 113 days.

(21) Appl. No.: 13/279,883

(22) Filed: Oct. 24, 2011

(65) Prior Publication Data

US 2012/0099909 A1 Apr. 26, 2012

(30) Foreign Application Priority Data

Oct. 25, 2010 (JP) ..... 2010-238345

(51) Int. Cl.
*G03G 15/20* (2006.01)

(52) U.S. Cl.
USPC ..... 399/329; 399/67

(58) Field of Classification Search
USPC ..... 399/69, 329
See application file for complete search history.

(56) References Cited

U.S. PATENT DOCUMENTS

| | | | | |
|---|---|---|---|---|
| 6,049,691 | A * | 4/2000 | Abe et al. | 399/330 |
| 7,433,639 | B2 * | 10/2008 | Yasuda et al. | 399/329 |
| 7,890,042 | B2 * | 2/2011 | Ishida et al. | 399/329 |
| 2004/0169036 | A1 * | 9/2004 | Katakabe et al. | 219/619 |
| 2004/0253027 | A1 * | 12/2004 | Kato et al. | 399/328 |
| 2005/0152720 | A1 * | 7/2005 | Katakabe et al. | 399/330 |
| 2005/0191098 | A1 * | 9/2005 | Ueno et al. | 399/329 |
| 2006/0029411 | A1 * | 2/2006 | Ishii et al. | 399/67 |
| 2006/0099001 | A1 * | 5/2006 | Asakura et al. | 399/69 |
| 2008/0124111 | A1 * | 5/2008 | Baba et al. | 399/69 |
| 2008/0247789 | A1 * | 10/2008 | Shin et al. | 399/329 |
| 2009/0175644 | A1 * | 7/2009 | Nanjo et al. | 399/69 |
| 2009/0245898 | A1 * | 10/2009 | Gon et al. | 399/328 |
| 2009/0317155 | A1 * | 12/2009 | Murakami et al. | 399/329 |
| 2009/0317157 | A1 * | 12/2009 | Murakami | 399/333 |
| 2009/0317158 | A1 * | 12/2009 | Murakami et al. | 399/333 |
| 2010/0014900 | A1 | 1/2010 | Gon | |
| 2010/0028061 | A1 * | 2/2010 | Nanjo et al. | 399/328 |
| 2010/0046996 | A1 * | 2/2010 | Nanjo et al. | 399/330 |
| 2010/0150621 | A1 * | 6/2010 | Sugaya | 399/328 |
| 2010/0215390 | A1 * | 8/2010 | Tomita et al. | 399/69 |
| 2010/0247183 | A1 * | 9/2010 | Haseba et al. | 399/329 |
| 2010/0272482 | A1 * | 10/2010 | Nanjo | 399/328 |
| 2010/0272483 | A1 * | 10/2010 | Nanjo | 399/331 |
| 2010/0322682 | A1 * | 12/2010 | Baba | 399/329 |
| 2011/0052281 | A1 * | 3/2011 | Gon | 399/329 |
| 2011/0217097 | A1 * | 9/2011 | Nanjo | 399/329 |
| 2012/0057909 | A1 * | 3/2012 | Gon | 399/329 |
| 2012/0148319 | A1 * | 6/2012 | Murakami et al. | 399/329 |
| 2012/0189361 | A1 * | 7/2012 | Murakami et al. | 399/328 |

FOREIGN PATENT DOCUMENTS

| | | |
|---|---|---|
| JP | 2004-151470 | 5/2004 |
| JP | 2010-026246 | 2/2010 |

* cited by examiner

*Primary Examiner* — Walter L Lindsay, Jr.
*Assistant Examiner* — David Bolduc
(74) *Attorney, Agent, or Firm* — Frommer Lawrence & Haug LLP

(57) ABSTRACT

A fixing device includes an induction coil, a heating rotary belt including a heat generating layer thinner than a magnetic-field penetration depth, a pressure receiving member, a pressing rotator, a magnetic core section, and a movable guiding section. The movable guiding section is a substantially cylindrical frame body being in contact with the inner surface of the heating rotary belt, includes one or more blocking sections, and is rotatable so as to be able to be positioned in a first blocking position and a first non-blocking position.

19 Claims, 13 Drawing Sheets

FIXING DEVICE INCLUDING MOVABLE FRAME BODY AND IMAGE FORMING APPARATUS INCLUDING THE SAME

INCORPORATION BY REFERENCE

This application is based upon and claims the benefit of priority from the corresponding Japanese Patent application No. 2010-238345, filed Oct. 25, 2010, the entire contents of which are incorporated herein by reference.

FIELD

The present disclosure relates to a fixing device and an image forming apparatus including the same.

BACKGROUND

Attention has been focused on belt-type fixing devices that can reduce thermal capacity in an image forming apparatus. Attention has also been given in recent years to induction heating (IH) type ones that can perform rapid heating or high-efficient heating.

In a fixing device that includes a heating rotary belt which generates heat by using electromagnetic induction heating, one proposed approach for suppressing an excessive temperature rise in a paper unpassing region (second region) outside a paper passing region (first region) in which paper as a recording medium passes when being conveyed (made to pass) through the fixing nip is by controlling the amount of heat generation of a heating rotator in the paper passing region and that in the paper unpassing region in response to the length of the paper (paper width) in a direction substantially perpendicular to the paper conveyance direction.

A fixing device utilizing electromagnetic induction heating and that includes a heating roller (heating rotator) being a metallic roller that includes a magnetic shunt alloy layer and an induction coil arranged inside the heating roller has been proposed.

For the proposed fixing device, in a paper unpassing region having an increased temperature resulting from paper not passing through that region, when the magnetic shunt alloy layer of the metallic roller is at or above the Curie temperature, the magnetic properties of the magnetic shunt alloy layer can be lost. The loss of the magnetic properties of the magnetic shunt alloy layer enables suppressing an excessive temperature rise in the paper unpassing region of the heating roller in response to the width of passing paper of each size.

However, for the proposed fixing device, a movable magnetic-flux blocking member for controlling the amount of heat generation of the heating rotary belt is arranged outside the heating rotary belt. This may lead to a large size of the fixing device.

For the proposed fixing device, it is necessary to make the magnetic shunt alloy layer of the heating roller thicker than a predetermined value. This may lead to increased thermal capacity of the fixing device.

Accordingly, it is desired that the fixing device be able to control the amount of heat generation of the heating rotator in the paper unpassing region and that in the paper passing region in response to each of the sizes of paper, and also be able to reduce (or at least avoid increasing) thermal capacity and suppress an increase in the size.

SUMMARY

The present disclosure relates to a fixing device that can control the amount of heat generation of a heating rotary belt in a first region (paper passing region) and a second region (paper unpassing region) in response to the size of a recording medium (paper). The present disclosure also relate to an image forming apparatus including the above-described fixing device.

A fixing device according to an aspect of the present disclosure includes an induction coil, a heating rotary belt, a pressure receiving member, a pressing rotator, a fixing nip, a magnetic core section, and a movable guiding section. The induction coil generates magnetic flux. The heating rotary belt is arranged in a region in which the magnetic flux passes and includes a heat generating layer thinner than a magnetic-field penetration depth. The pressure receiving member is arranged inside the heating rotary belt and is in contact with an inner surface of the heating rotary belt. The pressing rotator faces the heating rotary belt. The fixing nip is formed between the pressing rotator and the heating rotary belt being sandwiched between the pressure receiving member and the pressing rotator. In the fixing nip a recording medium is pinched and conveyed. The magnetic core section forms a circulating magnetic path that surrounds the induction coil. The movable guiding section is arranged inside the heating rotary belt, is in contact with the inner surface of the heating rotary belt, is a substantially cylindrical frame body, includes one or more blocking sections, and is rotatable so as to be able to be positioned in a first blocking position where the one or more blocking sections reduce or block the magnetic flux and in a first non-blocking position where the one or more blocking sections do not reduce or block the magnetic flux.

An image forming apparatus according to another aspect of the present disclosure includes an image bearing member, a developing device, a transfer section, and a fixing device. The image bearing member includes a surface that allows an electrostatic latent image to be formed thereon. The developing device develops the electrostatic latent image formed on the image bearing member as a toner image. The transfer section transfers the toner image formed on the image bearing member to a recording medium. The fixing device fixes the toner image transferred to the recording medium. The fixing device includes an induction coil that generates magnetic flux, a heating rotary belt arranged in a region in which the magnetic flux passes and including a heat generating layer thinner than a magnetic-field penetration depth, a pressure receiving member arranged inside the heating rotary belt and being in contact with an inner surface of the heating rotary belt, a pressing rotator facing the heating rotary belt, a fixing nip formed between the pressing rotator and the heating rotary belt being sandwiched between the pressure receiving member and the pressing rotator, in the fixing nip the recording medium is pinched and conveyed, a magnetic core section that forms a circulating magnetic path that surrounds the induction coil, and a movable guiding section arranged inside the heating rotary belt, being in contact with the inner surface of the heating rotary belt, being a substantially cylindrical frame body, including one or more blocking sections, and being rotatable so as to be able to be positioned in a first blocking position where the one or more blocking sections reduce or block the magnetic flux and in a first non-blocking position where the one or more blocking sections do not reduce or block the magnetic flux.

The above and other objects, features, and advantages of various embodiments of the present disclosure will be more apparent from the following detailed description of embodiments taken in conjunction with the accompanying drawings.

In this text, the terms "comprising", "comprise", "comprises" and other forms of "comprise" can have the meaning ascribed to these terms in U.S. Patent Law and can mean "including", "include", "includes" and other forms of "include". The phrase "an embodiment" as used herein does not necessarily refer to the same embodiment, though it may. In addition, the meaning of "a," "an," and "the" include plural references; thus, for example, "an embodiment" is not limited to a single embodiment but refers to one or more embodiments. As used herein, the term "or" is an inclusive "or" operator, and is equivalent to the term "and/or," unless the context clearly dictates otherwise. The term "based on" is not exclusive and allows for being based on additional factors not described, unless the context clearly dictates otherwise.

Various features of novelty which characterize various aspects of the disclosure are pointed out in particularity in the claims annexed to and forming a part of this disclosure. For a better understanding of the disclosure, operating advantages and specific objects that may be attained by some of its uses, reference is made to the accompanying descriptive matter in which exemplary embodiments of the disclosure are illustrated in the accompanying drawings in which corresponding components are identified by the same reference numerals.

BRIEF DESCRIPTION OF THE DRAWINGS

The following detailed description, given by way of example, but not intended to limit the disclosure solely to the specific embodiments described, may best be understood in conjunction with the accompanying drawings, in which.

DETAILED DESCRIPTION OF EMBODIMENTS

Reference will now be made in detail to various embodiments of the disclosure, one or more examples of which are illustrated in the accompanying drawings. Each example is provided by way of explanation of the disclosure, and by no way limiting the present disclosure. In fact, it will be apparent to those skilled in the art that various modifications, combinations, additions, deletions and variations can be made in the present disclosure without departing from the scope or spirit of the present disclosure. For instance, features illustrated or described as part of one embodiment can be used in another embodiment to yield a still further embodiment. It is intended that the present disclosure covers such modifications, combinations, additions, deletions, applications and variations that come within the scope of the appended claims and their equivalents.

An illustrative embodiment of the present disclosure is described below with reference to the drawings. The present disclosure is not limited to the embodiment described below, and various modifications can be made within the scope of the idea of the present disclosure.

Figure 1:
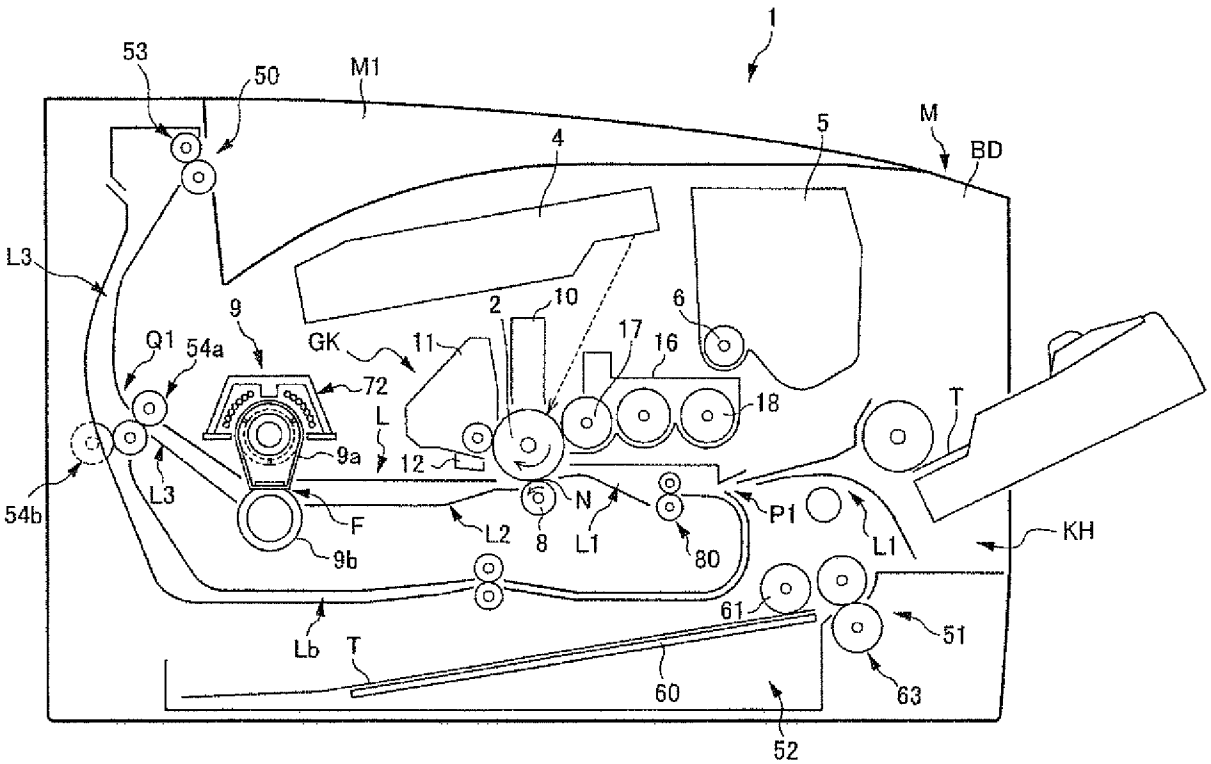
FIG. 1 is an illustration for illustrating an arrangement of components of a printer according to an embodiment of the present disclosure.

The structure of a printer 1 as an image forming apparatus according to the present embodiment is described with reference to FIG. 1. FIG. 1 is an illustration for illustrating an arrangement of components of the printer 1 of the present embodiment of the present disclosure. In the following description, the up and down direction in FIG. 1 is also referred to simply as "vertical direction."

As illustrated in FIG. 1, the printer 1 includes an apparatus main body M. The apparatus main body M includes an image forming section GK that forms a toner image on paper T as a recording medium on the basis of image information and a paper feed and ejection section KH that supplies the paper T to the image forming section GK and ejects the paper T on which a toner image is formed. The outer shape of the apparatus main body M is defined by a case BD as a casing.

As illustrated in FIG. 1, the image forming section GK includes a photosensitive drum 2 as an image bearing member (photosensitive member), a charging section 10, a laser scanner unit 4 as an exposure unit, a transfer roller 8, a developing device 16, a toner cartridge 5, a toner supply section 6, a drum cleaning section 11, a neutralization device 12, a transfer roller 8 as a transfer section, and a fixing device 9.

As illustrated in FIG. 1, the paper feed and ejection section KH includes a paper feed cassette 52, a conveying path L for use in conveying the paper T, a pair of registration rollers 80, and a paper ejection section 50.

Configurations of the image forming section GK and the paper feed and ejection section KH according to the present illustrative embodiment are described in detail below.

First, the image forming section GK is described. In the image forming section GK, in sequence from the upstream to downstream side in the direction of rotation of the photosensitive drum 2 along the surface of the photosensitive drum 2, the surface of the photosensitive drum 2 is subjected to charging by the charging section 10, exposure by the laser scanner unit 4, development by the developing device 16, transferring by the transfer roller 8, removal of electricity by the neutralization device 12, and cleaning by the drum cleaning section 11.

The photosensitive drum 2 is substantially cylindrical and functions as a photosensitive member or an image bearing member. The photosensitive drum 2 is rotatable in the direction indicated by the arrow illustrated in FIG. 1 about a rotation axis that extends in a direction substantially perpendicular to the conveyance direction of the paper T along the conveying path L. An electrostatic latent image can be formed on the surface of the photosensitive drum 2.

The charging section 10 faces the surface of the photosensitive drum 2. The charging section 10 substantially uniformly charges the surface of the photosensitive drum 2 negatively or positively (in polarity).

The laser scanner unit 4 functions as an exposure unit and is disposed apart from the surface of the photosensitive drum 2.

The laser scanner unit 4 can form an electrostatic latent image on the surface of the photosensitive drum 2 by scanning and exposing the surface of the photosensitive drum 2 on the basis of image information input from an external device, such as a personal computer (PC).

The developing device 16 faces the surface of the photosensitive drum 2. The developing device 16 develops an electrostatic latent image formed on the photosensitive drum 2 using a toner of monochromatic color (typically black) and forms a monochromatic toner image on the surface of the photosensitive drum 2. The developing device 16 includes a development roller 17 facing the surface of the photosensitive drum 2 and an agitation roller 18 for agitating toner.

The toner cartridge 5 is disposed in association with the developing device 16 and stores toner to be supplied to the developing device 16.

The toner supply section 6 is disposed in association with the toner cartridge 5 and the developing device 16 and supplies the toner from the toner cartridge 5 to the developing device 16.

The transfer roller 8 transfers the toner image formed on the surface of the photosensitive drum 2 to the paper T. The transfer roller 8 is rotatable in contact with the photosensitive drum 2.

A transfer nip N is formed between the photosensitive drum 2 and the transfer roller 8. The toner image on the photosensitive drum 2 is transferred to the paper T at the transfer nip N. The neutralization device 12 faces the surface of the photosensitive drum 2. The drum cleaning section 11 faces the surface of the photosensitive drum 2.

The fixing device 9 fuses and presses the toner forming the toner image transferred to the paper T to fix the toner image on the paper T. The details of the fixing device 9 are described below.

Next, the paper feed and ejection section KH is described.

As illustrated in FIG. 1, the single paper feed cassette 52 storing papers T is arranged in the lower portion of the apparatus main body M. The paper feed cassette 52 includes a mounting plate 60 on which the papers T are placed. The papers T placed on the mounting plate 60 are sent to the conveying path L by a cassette feed section 51. The cassette feed section 51 includes a mechanism for preventing multiple sheets feed, and the mechanism includes a forward-feed roller 61 for taking out the papers T on the mounting plate 60 and a pair of feeding rollers 63 for sending the paper T one by one to the conveying path L.

The paper ejection section 50 is arranged in the upper portion of the apparatus main body M. The paper ejection section 50 ejects the papers T to the outside of the apparatus main body M by the use of a pair of third rollers 53. The details of the paper ejection section 50 are described below.

The conveying path L for use in conveying the paper T includes a first conveying path L1 from the cassette feed section 51 to the transfer nip N, a second conveying path L2 from the transfer nip N to the fixing device 9, a third conveying path L3 from the fixing device 9 to the paper ejection section 50, and a return conveying path Lb for returning paper conveyed from the downstream toward the upstream in the third conveying path L3 to the first conveying path L1 such that the paper is turned upside down.

A first meeting point P1 is in the first conveying path L1. A first branch point Q1 is in the third conveying path L3.

A sensor (not illustrated) for detecting the paper T and the pair of registration rollers 80 are arranged in the first conveying path L1 (specifically, between the first meeting point P1 and the transfer nip N). The registration rollers 80 correct a skew of the paper T (a slant of a fed paper) and match the timing of formation of a toner image at the image forming section GK and that of conveyance of the paper T with each other.

The paper ejection section 50 is disposed at the downstream end of the third conveying path L3 in the conveyance direction of the paper T. The paper ejection section 50 ejects the paper T conveyed along the third conveying path L3 to the outside of the apparatus main body M by the use of the pair of third rollers 53.

An ejected paper accumulation section M1 is disposed adjacent to the opening of the paper ejection section 50. The ejected paper accumulation section M1 is disposed on the upper surface (outer surface) of the apparatus main body M. A sensor for detecting paper (not illustrated) is arranged at a predetermined position in each of the conveying paths.

Figure 2:
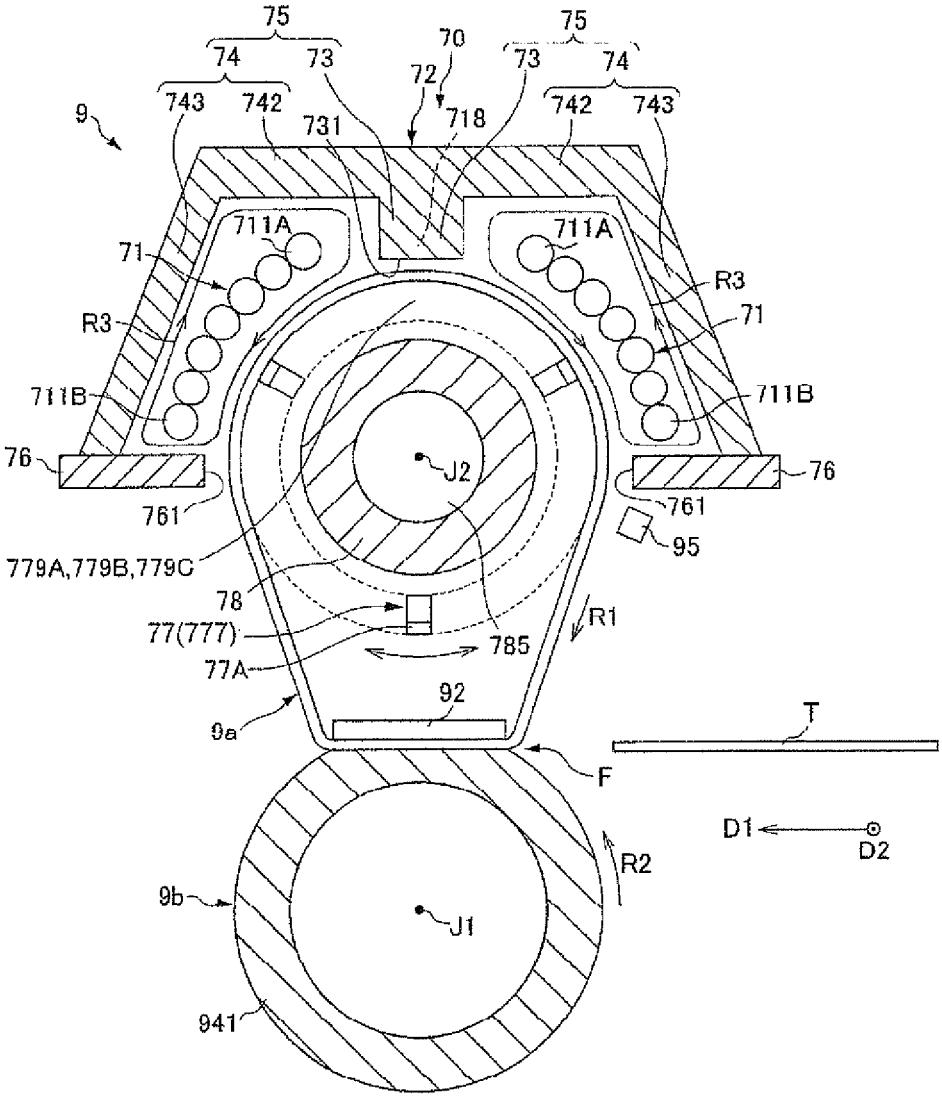
FIG. 2 is a cross-sectional view for illustrating components of a fixing device in the printer of the embodiment.
Figure 3:
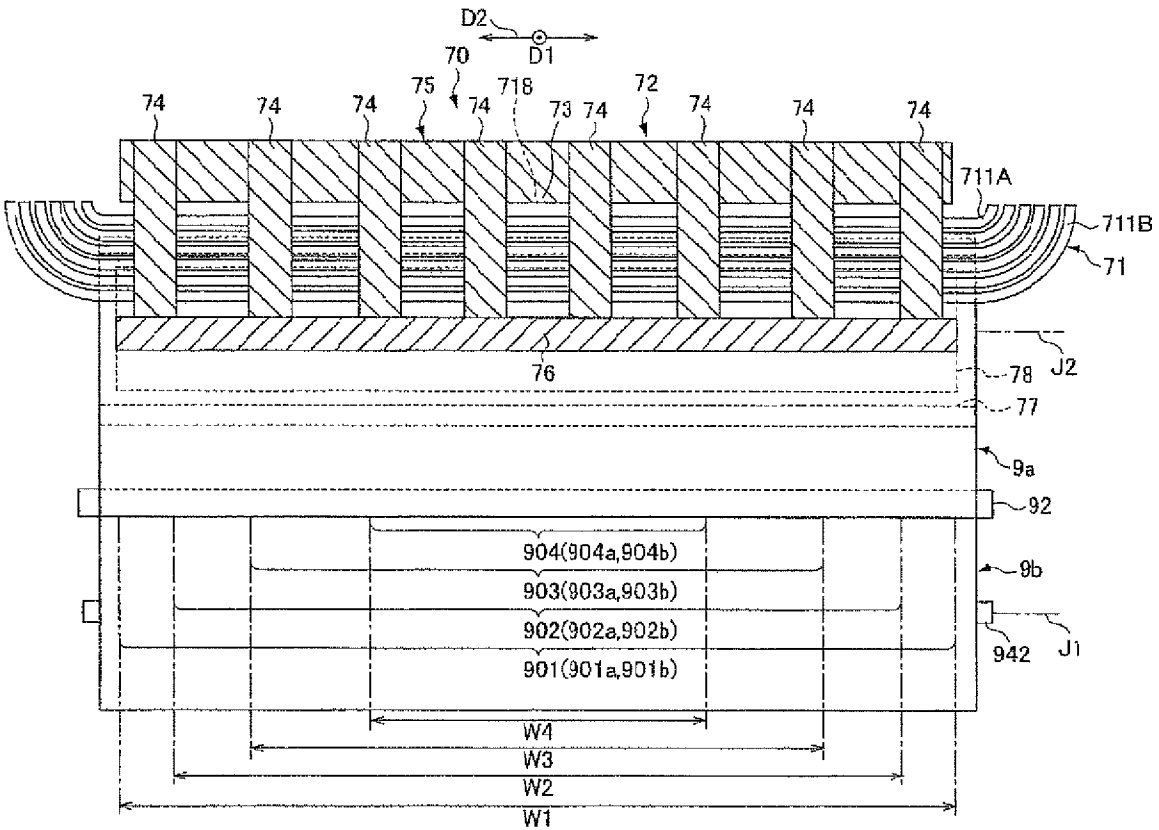
FIG. 3 illustrates the fixing device in FIG. 2 viewed from a conveyance direction of a recording medium.
Figure 4:
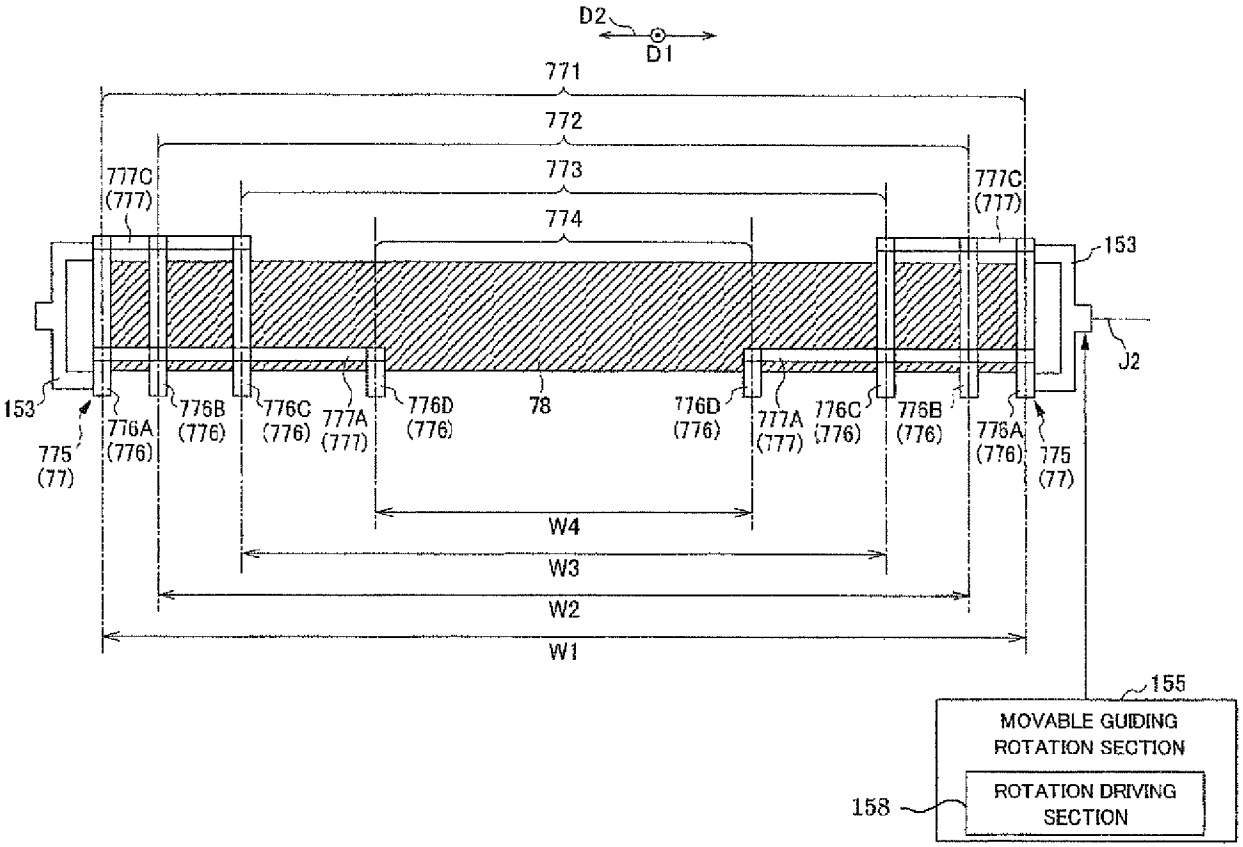
FIG. 4 is a conceptual illustration of a movable guiding section and an inner core section in the printer of the embodiment viewed from the conveyance direction of the recording medium.
Figure 5:
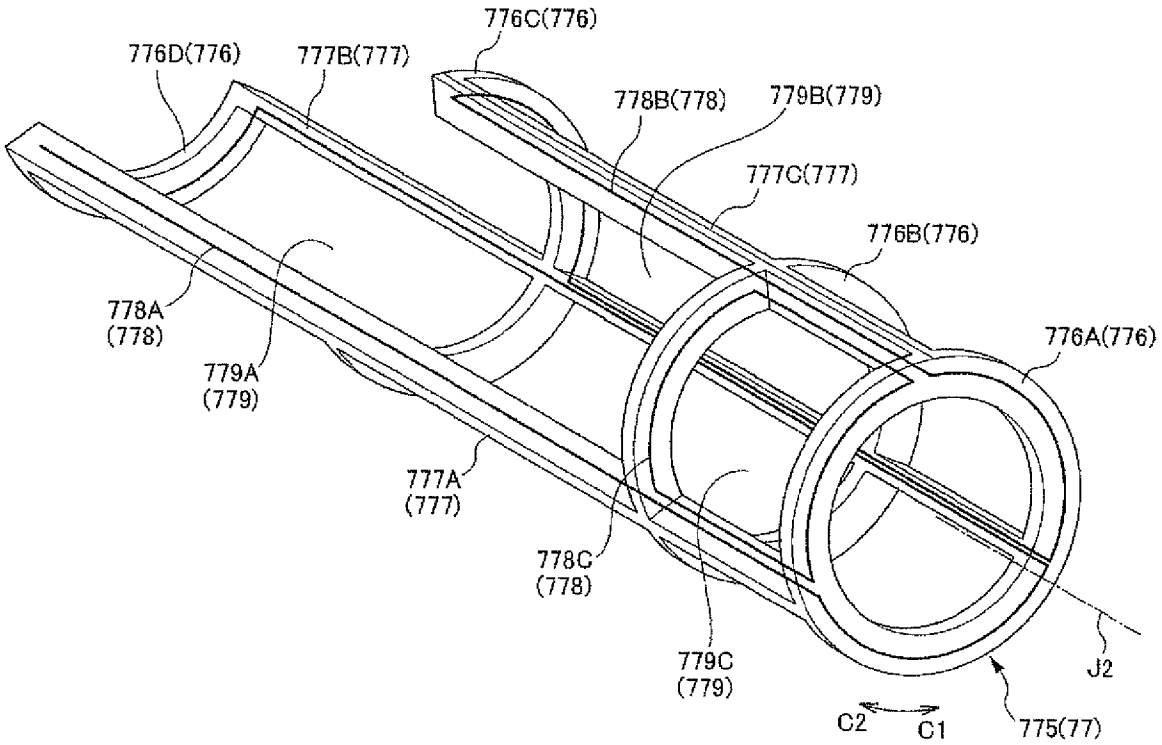
FIG. 5 is a perspective view that illustrates the shape of the movable guiding section in the printer of the embodiment.

Next, the configuration of the fixing device 9 and its relating components in the printer 1 of the present embodiment is described in detail. FIG. 2 is a cross-sectional view for illustrating the components of the fixing device 9 in the printer 1 of the present embodiment. FIG. 3 illustrates the fixing device 9 in FIG. 2 viewed from a conveyance direction D1 of the paper T. FIG. 4 is a conceptual illustration of a movable guiding section 77 and an inner core section 78 in the printer 1 of the present embodiment viewed from the conveyance direction D1 of the paper T. FIG. 5 is a perspective view that illustrates the shape of the movable guiding section 77 in the printer 1 of the embodiment.

Figure 6A:
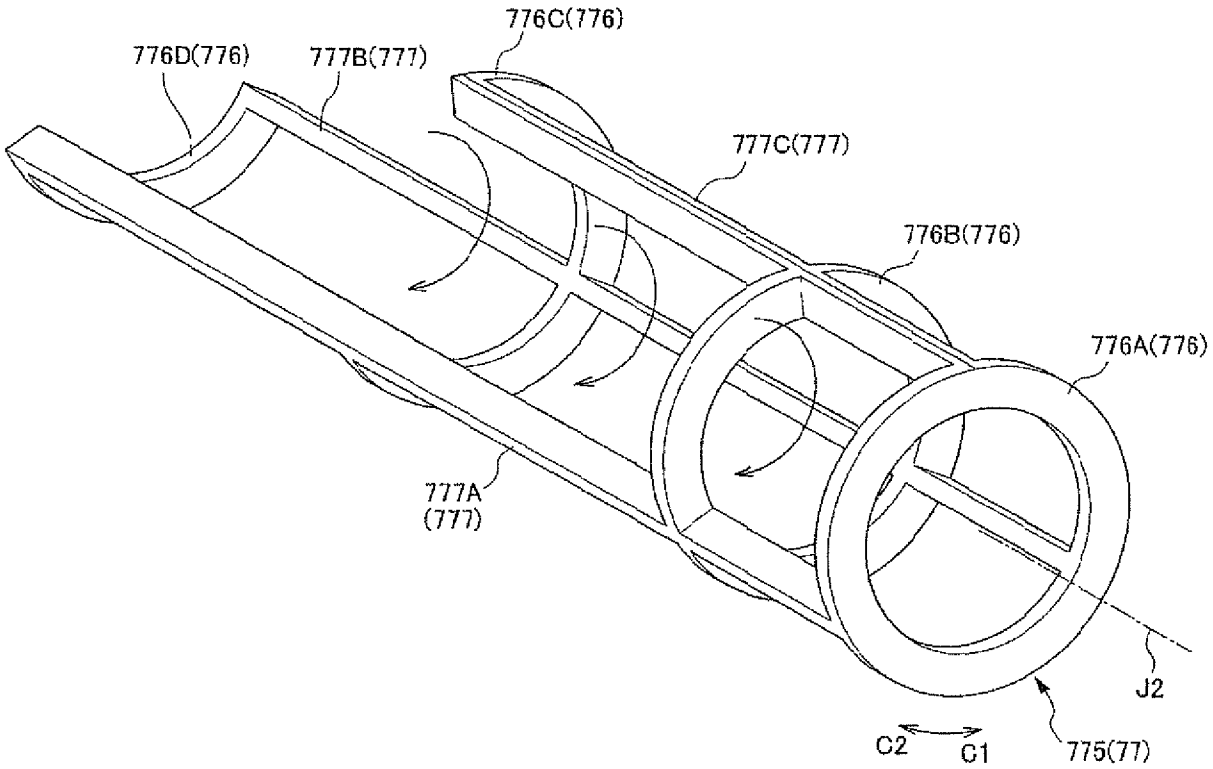
FIG. 6A is a perspective view that illustrates the movable guiding section which is positioned in a first rotation position.
Figure 6B:
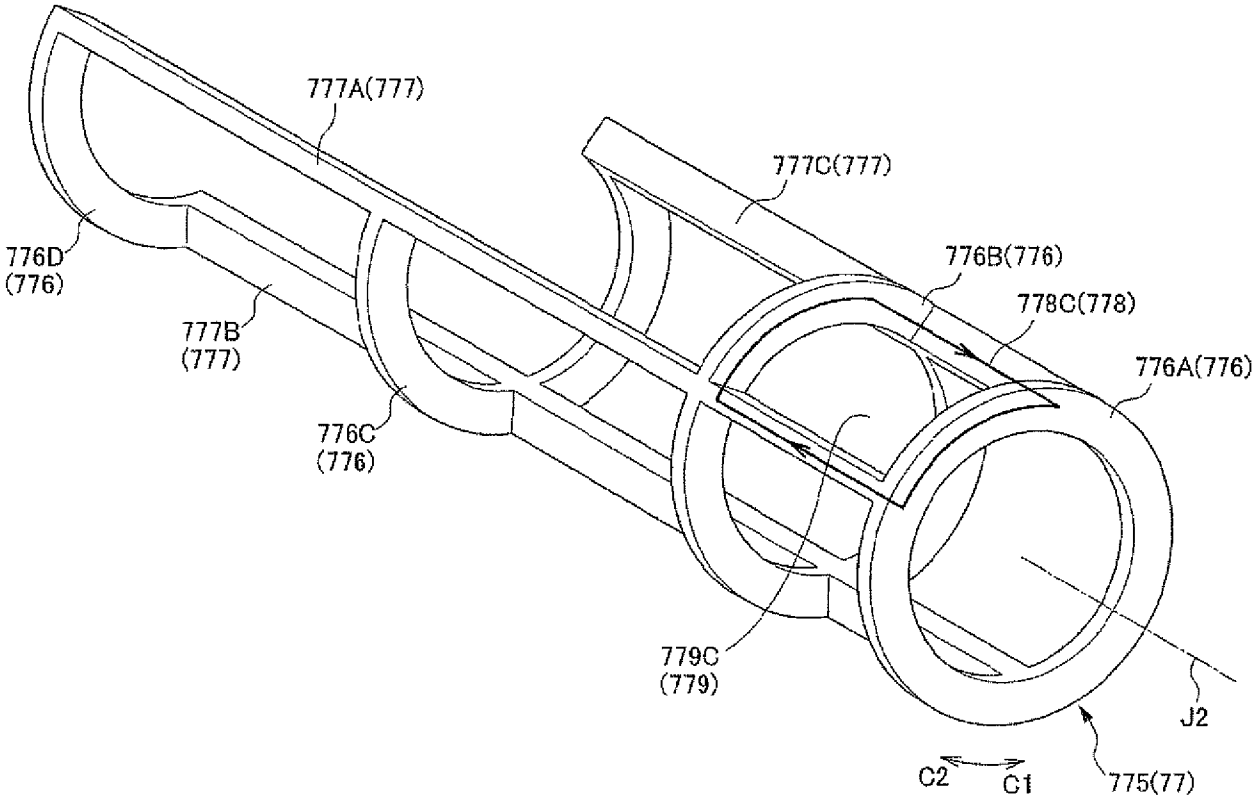
FIG. 6B is a perspective view that illustrates the movable guiding section which is positioned in a second rotation position.
Figure 6C:
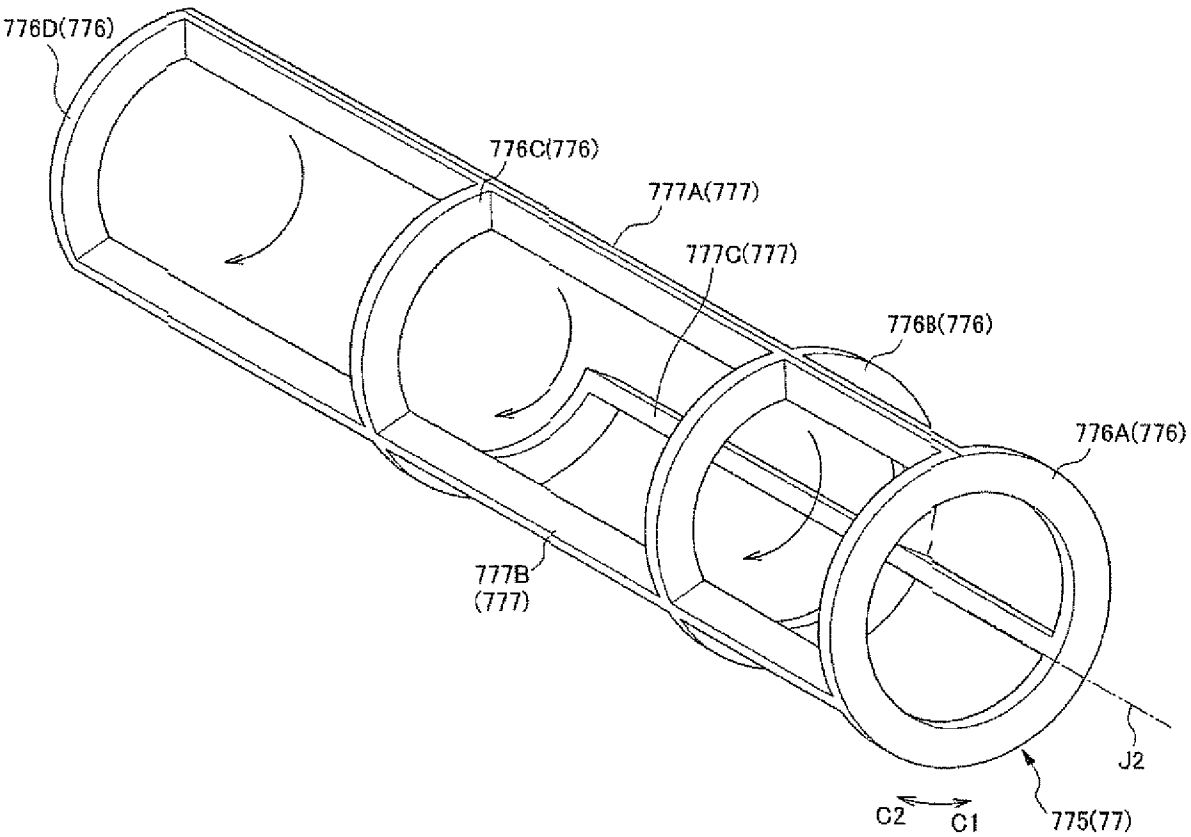
FIG. 6C is a perspective view that illustrates the movable guiding section which is positioned in a third rotation position.
Figure 6D:
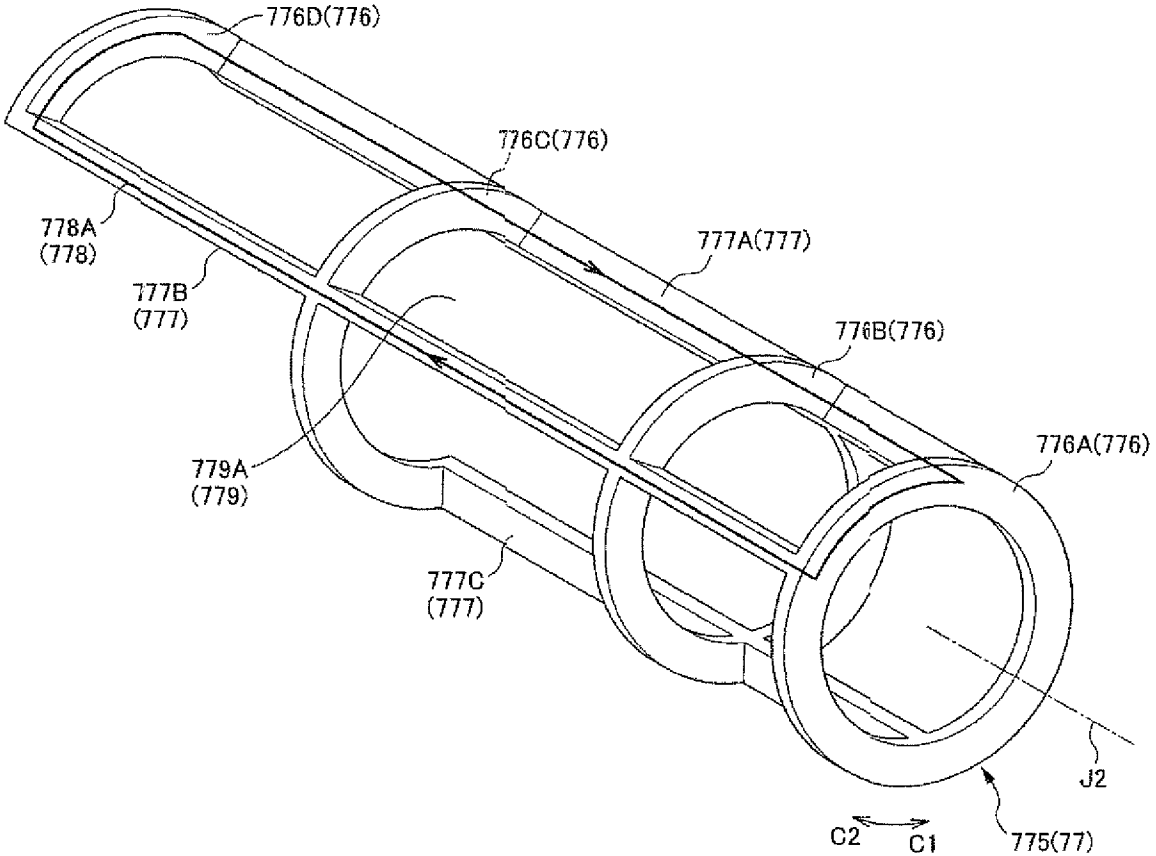
FIG. 6D is a perspective view that illustrates the movable guiding section which is positioned in a fourth rotation position.
Figure 6E:
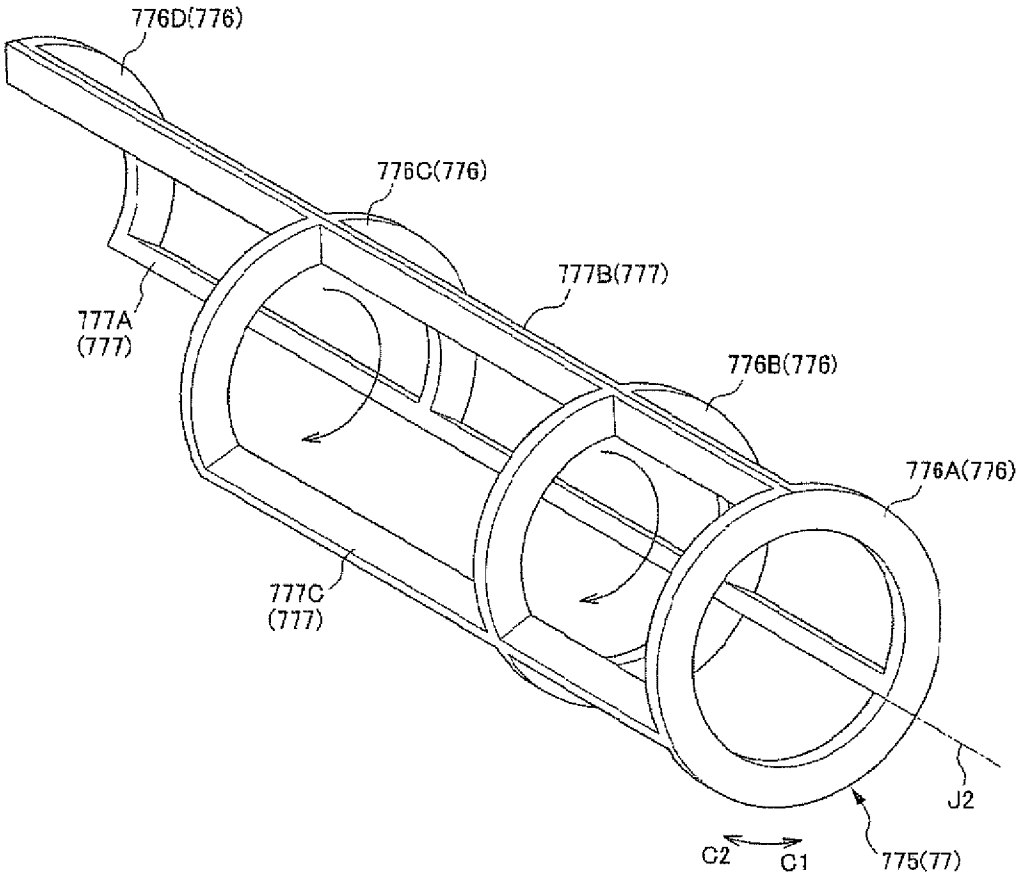
FIG. 6E is a perspective view that illustrates the movable guiding section which is positioned in a fifth rotation position.
Figure 6F:
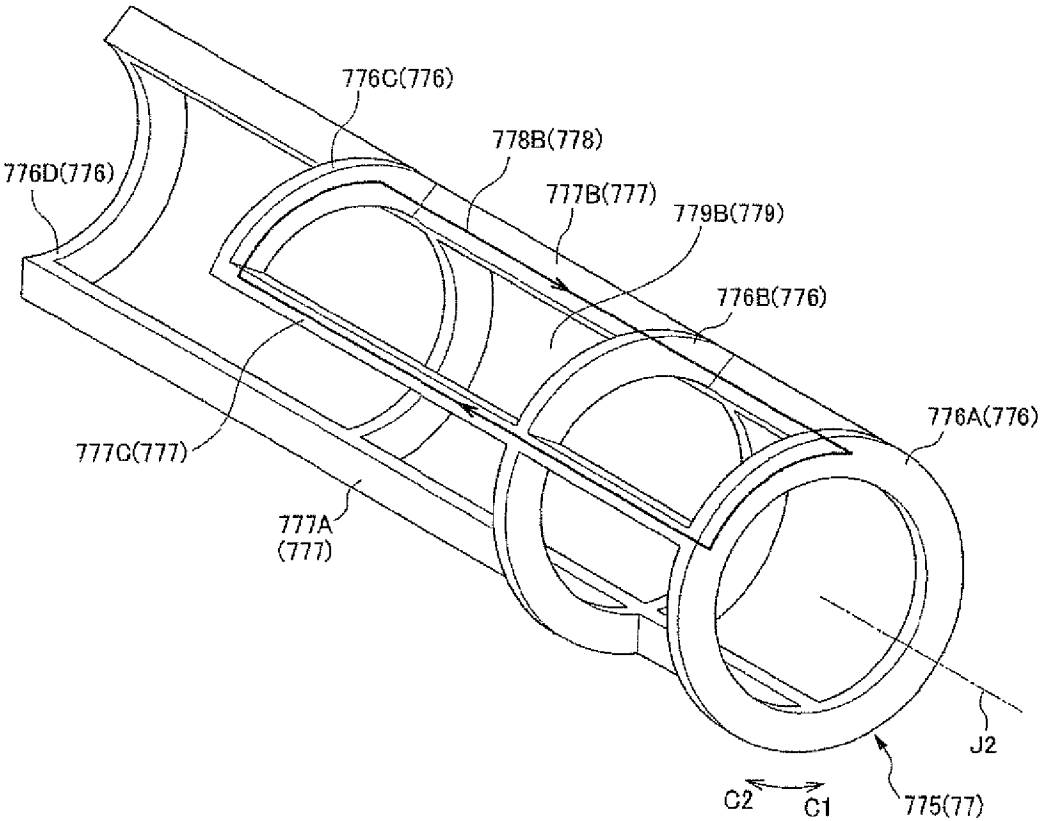
FIG. 6F is a perspective view that illustrates the movable guiding section which is positioned in a sixth rotation position.
Figure 7A:
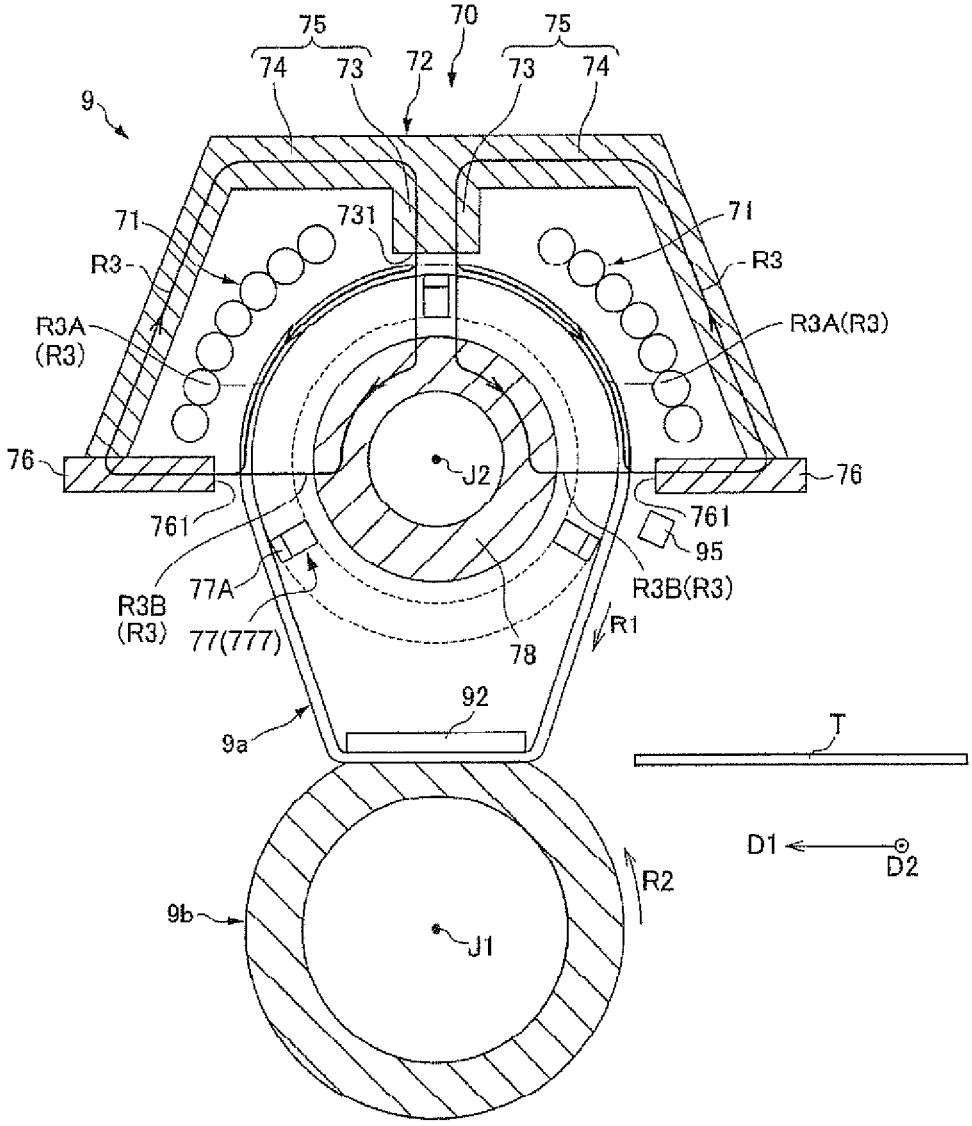
FIG. 7A is a cross-sectional view for illustrating magnetic flux that passes along a magnetic path when the movable guiding section is positioned in a first non-blocking position.
Figure 7B:
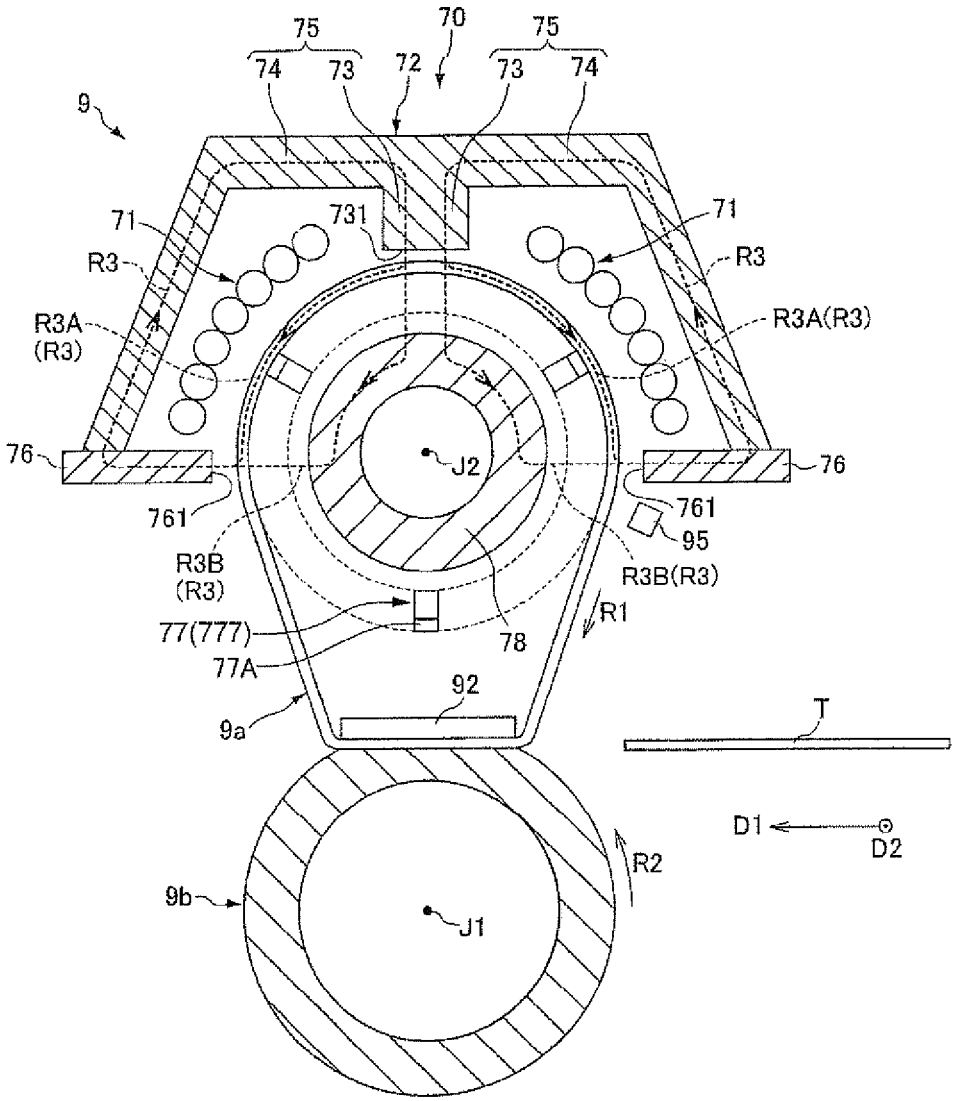
FIG. 7B is a cross-sectional view for illustrating magnetic flux that passes along the magnetic path when the movable guiding section is positioned in a first blocking position.

FIG. 6A is a perspective view that illustrates the movable guiding section 77 which is positioned in a first rotation position. FIG. 6B is a perspective view that illustrates the movable guiding section 77 which is positioned in a second rotation position. FIG. 6C is a perspective view that illustrates the movable guiding section 77 which is positioned in a third rotation position. FIG. 6D is a perspective view that illustrates the movable guiding section 77 which is positioned in a fourth rotation position. FIG. 6E is a perspective view that illustrates the movable guiding section 77 which is positioned in a fifth rotation position. FIG. 6F is a perspective view that illustrates the movable guiding section 77 which is positioned in a sixth rotation position. FIG. 7A is a cross-sectional view for illustrating magnetic flux that passes along a magnetic path when the movable guiding section 77 is positioned in a first non-blocking position. FIG. 7B is a cross-sectional view for illustrating the magnetic flux that passes along the magnetic path when the movable guiding section 77 is positioned in a first blocking position.

As illustrated in FIG. 2, the fixing device 9 includes a heating rotary belt 9*a*, a pressing roller 9*b* as a pressing rotator pressed in contact with the heating rotary belt 9*a*, a heating unit 70, a pressure receiving member 92, and a temperature sensor 95.

The heating rotary belt 9*a* is loop-shaped (tubular and endless-belt shaped). The heating rotary belt 9*a* is a belt that has low thermal capacity. The heating rotary belt 9*a* is rotatable in a first circumferential direction R1. For the present embodiment, a direction D2 substantially perpendicular to the first circumferential direction R1 is also referred to as "paper-width direction D2." The heating rotary belt 9*a* generates heat by using induction heating (IH) employing electromagnetic induction by the use of the heating unit 70, which is described below. The heating rotary belt 9*a* is arranged in a region in which magnetic flux generated by an induction coil 71 of the heating unit 70 passes.

The pressure receiving member 92 and the movable guiding section 77, which are described below, are arranged in an inner space of the heating rotary belt 9*a*. The heating rotary belt 9*a* to which a predetermined tension is applied is stretched around the movable guiding section 77 and the pressure receiving member 92.

The internal circumferential surface (inner surface) of the heating rotary belt 9*a* is in contact with the pressure receiving member 92 in a location adjacent to the pressing roller 9*b* (in a lower inner portion of the heating rotary belt 9*a* in the vertical direction) and is also in contact with the movable guiding section 77 in a location adjacent to a central core section 73 (in an upper inner portion of the heating rotary belt 9*a* in the vertical direction). The inner core section 78 as a fourth core section made of a magnetic material is arranged inside the movable guiding section 77, which is arranged inside the heating rotary belt 9*a*. The pressing roller 9*b*, central core section 73, and inner core section 78 are described below.

A lubricant (not illustrated) as a second low-friction member is applied (arranged) on the inner circumferential surface of the heating rotary belt 9*a*. For the present embodiment, the lubricant is grease that has a coefficient of friction lower than that of the substrate (magnetic metal layer) of the heating rotary belt 9*a*. The pressure receiving member 92 and the movable guiding section 77 are described below.

For the present embodiment, the substrate of the heating rotary belt 9*a* as a heat generating layer principally includes a ferromagnetic material, such as nickel. The substrate of the heating rotary belt 9*a* is thinner than the magnetic-field penetration depth. The outer circumferential surface of the substrate of the heating rotary belt 9*a* is overlaid with a silicone rubber elastic layer that may have a thickness of approximately 0.3 mm, and the outer circumferential surface of the elastic layer is overlaid with a release layer made of a heat-resistant film that may have a thickness of approximately 30 μM. The heat-resistant film is made of a fluorocarbon polymer, such as PFA (a copolymer of tetrafluoroethylene and perfluoroalkylvinylether) or PTFE (polytetrafluoroethylene).

The heating rotary belt 9*a* is arranged in a region in which the magnetic flux generated by the induction coil 71 of the heating unit 70, which is described below, passes and thus forms the magnetic path for the magnetic flux generated by the induction coil 71 of the heating unit 70.

The magnetic-field penetration depth is described here. The magnetic-field penetration depth is the depth from the surface of the substrate (magnetic metal layer) of the heating rotary belt 9*a* at which the value of an eddy current density is 1/e (e: the base of the natural logarithm) of that of the surface of the substrate of the heating rotary belt 9*a*. Virtually no eddy current flows in a location whose depth from the surface of the substrate is deeper than the magnetic-field penetration depth.

The magnetic-field penetration depth can be represented by the following expression:

$$\delta=503\sqrt{(\rho/f\mu)}$$

where δ is the magnetic-field penetration depth of the substrate, ρ is the electrical resistance of the substrate, f is the frequency of the magnetic flux, and μ is the relative permeability.

For example, in the case in which nickel is used for the substrate of the heating rotary belt 9*a* and a current with a frequency f of 30 kHz is made to flow in the induction coil 71, because the electrical resistance p of nickel is about $6.80\times10^{-8}$ Ω·m and the relative permeability μ is about 300, the magnetic-field penetration depth δ is about 43.7 μm.

In the case in which the substrate is equal to or thicker than the magnetic-field penetration depth, virtually no eddy current flows in a location whose depth from the surface of the substrate is deeper than the magnetic-field penetration depth. Therefore, the magnetic flux generated by the induction coil 71 does not reach the location deeper than the magnetic-field penetration depth. Accordingly, the magnetic flux generated by the induction coil 71 does not penetrate entirely through the substrate and is guided along the substrate of the heating rotary belt 9*a*.

In the case in which the substrate is thinner than the magnetic-field penetration depth, the magnetic field generated by the induction coil 71 partly penetrates entirely through the substrate of the heating rotary belt 9*a* and partly does not penetrate entirely through the heating rotary belt 9*a*. The magnetic flux that does not penetrate (i.e., pass entirely through) the substrate of the heating rotary belt 9*a* is guided along the substrate of the heating rotary belt 9*a*. The amount of the magnetic flux that penetrates the substrate of the heating rotary belt 9*a* increases with a reduction in the thickness of the substrate. The thickness of the substrate of the heating rotary belt 9*a* is appropriately set within the range thinner than the magnetic-field penetration depth.

For the present illustrative embodiment, the thickness of the substrate of the heating rotary belt 9*a* is approximately 40 μm, whereas the magnetic-field penetration depth is about 43.7 μm. Thus, approximately 50% magnetic flux generated by the induction coil 71 penetrates (entirely through) the heating rotary belt 9*a*.

An eddy current (induced current) is generated by the magnetic flux that does not penetrate the substrate of the heating rotary belt 9*a* and that passes in the substrate of the heating rotary belt 9*a*. The eddy current flowing in the substrate of the heating rotary belt 9*a* causes Joule heat due to the electrical resistance of the substrate of the heating rotary belt 9*a*. In this way, the substrate of the heating rotary belt 9*a* generates heat due to induction heating using electromagnetic induction performed by the heating unit 70, which is described below.

In the present illustrative embodiment, the pressing roller 9*b* as the pressing rotator is substantially cylindrical. The pressing roller 9*b* faces the heating rotary belt 9*a* and is arranged below the heating rotary belt 9*a* in the vertical direction. The pressing roller 9*b* is rotatable in a second circumferential direction R2 about a first rotation axis J1 substantially parallel with the paper-width direction D2. The pressing roller 9*b* is long in the direction of the first rotation axis J1.

The pressing roller 9*b* is arranged such that its outer circumferential surface is in contact with the outer circumferential surface (outer surface) of the heating rotary belt 9*a*. The pressing roller 9*b* presses the pressure receiving member 92, which is described below, through the heating rotary belt 9*a*. Part of the heating rotary belt 9*a* is sandwiched between the pressing roller 9*b* and the pressure receiving member 92, and a fixing nip F is formed between the pressing roller 9*b* and the heating rotary belt 9*a*. At the fixing nip F, the paper T is pinched and conveyed.

The pressing roller 9*b* includes a pressing-roller main body 941 and a pair of shaft members 942 (see FIG. 3) coaxial with the first rotation axis J1. The pressing-roller main body 941 includes a substantially cylindrical metallic member, an elastic layer on the outer circumferential surface of the metallic layer, and a release layer on the outer circumferential surface of the elastic layer.

One of the shaft members 942 of the pressing roller 9*b* is connected to a rotation driving section (not illustrated) for rotating the pressing roller 9*b*. This rotation driving section drives the pressing roller 9*b* such that it is rotated at a predetermined speed, and the rotation of the pressing roller 9*b* is followed by the heating rotary belt 9*a*, which is in contact with the outer circumferential surface of the pressing roller 9*b*, and the heating rotary belt 9*a* is thus rotated.

The pressure receiving member 92 is arranged in the inner space of the heating rotary belt 9*a*. The pressure receiving member 92 is in contact with the inner circumferential surface of the heating rotary belt 9*a* in a location adjacent to the pressing roller 9*b*. The pressure receiving member 92 is long in the paper-width direction D2. The heating rotary belt 9*a* is sandwiched between the pressure receiving member 92 and the pressing roller 9*b*, and the fixing nip F is formed between the heating rotary belt 9*a* and the pressing roller 9*b*. The pressure receiving member 92 is in contact with the inner circumferential surface of the heating rotary belt 9*a* while sliding thereon.

When the paper T conveyed to the fixing nip F passes through a paper passing region (first region) of the fixing device 9, a toner image is fixed on the paper T. The "paper passing region" (first region) indicates the region where the paper T conveyed to the fixing nip F passes therethrough while being pinched between the heating rotary belt 9*a* and the pressing roller 9*b*. A region where the paper T does not pass therethrough outside the paper passing region in the case in which the paper T is conveyed to the fixing nip F is also referred to as a "paper unpassing region" (second region).

As illustrated in FIG. 3, a maximum paper passing region 901 is set as a paper passing region in the case in which the paper T having the maximum length in the paper-width direction D2 is conveyed to the fixing nip F. The maximum paper passing region 901 is set for each printer 1.

Specifically, for the outer circumferential surface of the heating rotary belt 9*a*, a heating-side maximum paper passing region 901*a* is formed (set) as the maximum paper passing region 901 of the heating rotary belt 9*a*. For the outer circumferential surface of the pressing roller 9*b*, a pressing-side maximum paper passing region 901*b* is formed (set) as the maximum paper passing region 901 of the pressing roller 9*b* in association with the heating-side maximum paper passing region 901*a* of the heating rotary belt 9*a*. The length of the heating-side maximum paper passing region 901*a* in a direction substantially parallel with the paper-width direction D2 is referred to as a "maximum paper passing width W1."

A minimum paper passing region 904 is set as the paper passing region in the ease in which the paper T having the minimum length in the paper-width direction D2 is conveyed to the fixing nip F. Specifically, for the outer circumferential surface of the heating rotary belt 9*a*, a heating-side minimum paper passing region 904*a* is formed (set) as the minimum paper passing region 904 of the heating rotary belt 9*a*. For the outer circumferential surface of the pressing roller 9*b*, a pressing-side minimum paper passing region 904*b* is formed (set) as the minimum paper passing region 904 of the pressing roller 9*b* in association with the heating-side minimum paper passing region 904*a* of the heating rotary belt 9*a*. The length of the heating-side minimum paper passing region 904*a* in the direction substantially parallel with the paper-width direction D2 is referred to as a "minimum paper passing width W4."

The fixing device 9 of the present embodiment includes two kinds of paper passing region for the case in which the paper T having an intermediate length (intermediate width) that is shorter than the maximum length and longer than the minimum length in the paper-width direction D2 is conveyed to the fixing nip F; namely, a first intermediate paper passing region 902 (a first heating-side intermediate paper passing region 902*a* and a first pressing-side intermediate paper passing region 902*b*) and a second intermediate paper passing region 903 (a second heating-side intermediate paper passing region 903*a* and a second pressing-side intermediate paper passing region 903*b*) are set. The length in the paper-width direction D2 of the first intermediate paper passing region 902 is longer than that of the second intermediate paper passing region 903. The length in the direction substantially parallel with the paper-width direction D2 of the first heating-side intermediate paper passing region 902*a* is referred to as a "first intermediate paper passing width W2" and that of the second heating-side intermediate paper passing region 903*a* is referred to as a "second intermediate paper passing width W3." The paper passing regions for the papers T are not limited to the above-described disclosures; they can also be set at any values in response to each of the possible sizes of the paper T.

The heating unit 70 is described below. As illustrated in FIGS. 2 and 3, the heating unit 70 includes the induction coil 71, a magnetic core section 72, and the movable guiding section 77. The induction coil 71 is spaced away from the outer circumferential surface of the heating rotary belt 9*a* by a predetermined distance and is arranged along the outer circumferential surface of the heating rotary belt 9*a*. In plan view (when viewed from above in FIGS. 2 and 3), the induction coil 71 is implemented as a wire wound so as to be long in the paper-width direction D2. The induction coil 71 is longer than the heating rotary belt 9*a* in the paper-width direction D2.

In accordance with some embodiments, the induction coil 71 is implemented using wound copper Litz wire. The induction coil 71 faces approximately half the upper portion of the outer circumferential surface of the heating rotary belt 9*a*.

As illustrated in FIGS. 2 and 3, the induction coil 71 is arranged so as to surround a central region 718 extending along the paper-width direction D2.

For the present embodiment, the induction coil 71 is fixed on a support member (not illustrated) made of a heat-resistant resin material.

The induction coil 71 is connected to an induction heating circuit section (not illustrated) for supplying an alternating current necessary to cause the induction coil 71 to generate the magnetic flux. The alternating current is applied from the induction heating circuit section to the induction coil 71. The application of the alternating current from the induction heating circuit section makes the induction coil 71 generate the magnetic flux for causing the heating rotary belt 9*a* to generate heat. For example, an alternating current whose frequency is approximately 30 KHz is applied to the induction coil 71. The magnetic flux generated by the induction coil 71 is guided by the magnetic path that is a path for the magnetic flux formed by the heating rotary belt 9*a* and the magnetic core section 72, which is described below.

The magnetic path is formed by the heating rotary belt 9*a* and the magnetic core section 72, which is described below, such that the magnetic flux generated by the induction coil 71 circles in a circling direction R3. The circling direction R3 is a direction which passes inside an inner edge 711A and outside an outer edge 711B of the induction coil 71 and circles so as to surround the wire portion of the induction coil 71. The magnetic flux generated by the induction coil 71 passes along the magnetic path.

Because the alternating current is applied from the induction heating circuit section (not illustrated) to the induction coil 71, the magnitude and direction of the magnetic flux generated by the induction coil 71 are varied to the positive or negative direction by periodic changes in the alternating current. The variation in the magnetic flux causes the induced current (eddy current) to occur in the substrate of the heating rotary belt 9*a*.

The magnetic core section 72 forms the magnetic path circulating in the circling direction R3, as illustrated in FIG. 2. Because the magnetic core section 72 is arranged in the region in which the magnetic flux generated by the induction coil 71 passes and is principally composed of a ferromagnetic material, the magnetic core section 72 forms the magnetic path for the magnetic flux generated by the induction coil 71.

The magnetic core section 72 includes an upper core section 75, a pair of side core sections 76 as a third core section, and the inner core section 78 as the fourth core section. The upper core section 75, side core sections 76, and inner core section 78 can be principally composed of a magnetic core made of a ferromagnetic material formed by sintering of ferrite powders.

The upper core section 75 includes the central core section 73 as the second core section, a plurality of pairs of arch core sections 74 as a plurality of first core sections such that they are formed integrally with each other. When viewed in the paper-width direction D2, the central core section 73 is arranged in a portion above the heating rotary belt 9*a* in the vertical direction (in the vicinity of the central region 718) at a substantially central location in the conveyance direction D1 of the paper T of the heating rotary belt 9*a*.

The plurality of pairs of arch core sections 74 are arranged in pairs at the downstream and upstream sides in the conveyance direction D1 with respect to the central core section 73. The central core section 73 and the plurality of pairs of the arch core sections 74 are integrally arranged at predetermined positions in the paper-width direction D2 and aligned in sequence along the magnetic-path circling direction R3.

As illustrated in FIG. 7A, the central core section 73 forms a magnetic path between the arch core sections 74 and the heating rotary belt 9*a* and a magnetic path between the arch core sections 74 and the inner core section 78 in the magnetic-path circling direction R3. Both of the magnetic paths are described below. The central core section 73 is arranged in the vicinity of the central region 718 (in the vicinity of the wire arranged at the inner edge 711A of the induction coil 71).

The central core section 73 is spaced away from the outer circumferential surface of the heating rotary belt 9*a* by a predetermined distance and faces the outer circumferential surface of the heating rotary belt 9*a*. The central core section 73 includes a first facing surface 731 facing the outer circumferential surface of the heating rotary belt 9*a* such that the induction coil 71 is not disposed therebetween.

As illustrated in FIG. 3, the central core section 73 has a substantially rectangular parallelepiped shape that is long in the paper-width direction D2. The central core section 73 has a length approximately equal to the maximum paper passing width W1 of the paper T having the maximum length in the paper-width direction D2.

Each of the plurality of pairs of arch core sections 74 extends from the upper portion of the central core section 73 toward the upstream and downstream sides in the conveyance direction D1 of the paper T. Each of the plurality of pairs of arch core sections 74 forms a magnetic path opposite to the heating rotary belt 9*a* with respect to the induction coil 71 (in an external area to the induction coil 71) in the magnetic-path circling direction R3, as illustrated in FIG. 2.

Each of the plurality of pairs of arch core sections 74 faces the outer circumferential surface of the heating rotary belt 9*a* such that the induction coil 71 is disposed therebetween. The plurality of pairs of arch core sections 74 are arranged in pairs at the downstream and upstream sides in the conveyance direction D1 of the paper T. Each of the plurality of pairs of arch core sections 74 has an arch shape that extends along the circumferential direction of the heating rotary belt 9*a*. The arch core section 74 includes a horizontal section 742 and an inclined section 743.

As illustrated in FIG. 3, the plurality of pairs of arch core sections 74 are spaced at predetermined intervals in the paper-width direction D2. The plurality of pairs of arch core sections 74 spaced at predetermined intervals in the paper-width direction D2 form a plurality of magnetic paths circulating in the circling direction R3.

As illustrated in FIG. 2, each of the pair of side core sections 76 forms a magnetic path (see FIG. 7A) between the corresponding arch core section 74 and each of the heating rotary belt 9*a* and the inner core section 78 (described below) in the magnetic-path circling direction R3. Each of the pair of side core sections 76 and each of the plurality of pairs of arch core sections 74 are arranged in sequence along the magnetic-path circling direction R3.

Each of the pair of side core sections 76 is arranged in the vicinity of the outer edge 711B of the induction coil 71. Each of the pair of side core sections 76 is spaced away from the outer circumferential surface of the heating rotary belt 9*a* by a predetermined distance and faces the outer circumferential surface of the heating rotary belt 9*a*. Each of the pair of side core sections 76 includes a second facing surface 761 facing the outer circumferential surface of the heating rotary belt 9*a* such that the induction coil 71 is not disposed therebetween. Each of the pair of side core sections 76 has a substantially rectangular parallelepiped shape that is long in the paper-width direction D2. As illustrated in FIG. 3, each of the pair of side core sections 76 has a length approximately equal to the length of the region in association with the maximum paper passing region 901 in the paper-width direction D2.

The inner core section 78 is described below. As illustrated in FIG. 2, the inner core section 78 is arranged in an inner empty space of the movable guiding section 77 and is not in contact with the movable guiding section 77. Inside the heating rotary belt 9*a* along the magnetic-path circling direction R3, the inner core section 78 is arranged along with the central core section 73 and the side core section 76 and forms a magnetic path between the central core section 73 and the side core section 76 (see FIG. 7A). The inner core section 78 faces the first facing surface 731 of the central core section 73 such that the heating rotary belt 9*a* is disposed therebetween and also faces the second facing surface 761 of the side core section 76 such that the heating rotary belt 9*a* is disposed therebetween.

As illustrated in FIGS. 2 to 4, the inner core section 78 has a substantially cylindrical shape that is long in the paper-width direction D2 and has a length approximately equal to the maximum paper passing width W1 of the paper T having the maximum length. The inner core section 78 is supported by an inner core shaft 785 (see FIG. 2).

As illustrated in FIG. 2, the movable guiding section 77 is in contact with the inner circumferential surface of the heating rotary belt 9*a* adjacent to the central core section 73 (in the upper portion in the vertical direction). In other words, the movable guiding section 77 is in contact with the inner circumferential surface of the heating rotary belt 9*a* above the pressure receiving member 92, which is present inside the heating rotary belt 9*a*, in the vertical direction.

The movable guiding section 77 includes substantially cylindrical frame bodies (a pair of blocking frame bodies 775 described below) and is long in the paper-width direction D2.

As illustrated in FIG. 3, the movable guiding section 77 has a length approximately equal to or slightly longer than the maximum paper passing width W1 of the paper T having the maximum length in the paper-width direction D2. The movable guiding section 77 has the inner empty space. As illustrated in FIG. 2, the inner core section 78, which is described above, is arranged in the inner empty space of the movable guiding section 77. The movable guiding section 77 is rotatable about a movable rotation axis J2 substantially parallel with the paper-width direction D2.

The movable guiding section 77 positions the heating rotary belt 9*a* by being in contact with the inner circumferential surface of the heating rotary belt 9*a* such that the distance between the heating rotary belt 9*a* and the induction coil 71 remains constant. The movable guiding section 77 guides the rotation of the heating rotary belt 9*a* so as to maintain the rotation path of the heating rotary belt 9*a*.

As illustrated in FIG. 4, the movable guiding section 77 includes, along the paper-width direction D2, a maximum-paper-passing-region corresponding region 771 in association with the heating-side maximum paper passing region 901*a*, a first-intermediate-paper-passing-region corresponding region 772 in association with the first heating-side intermediate paper passing region 902*a*, a second-intermediate-paper-passing-region corresponding region 773 in association with the second heating-side intermediate paper passing region 903*a*, and a minimum-paper-passing-region corresponding region 774 in association with the heating-side minimum paper passing region 904*a*.

The movable guiding section 77 includes the pair of blocking frame bodies 775 spaced away from each other in the paper-width direction D2. Both of the blocking frame bodies 775 have substantially the same configuration; accordingly, only one of them is sometimes specifically described in the following description.

As illustrated in FIGS. 4 and 5, each of the blocking frame bodies 775 of the movable guiding section 77 includes a plurality of frame members 776 spaced away from each other in the paper-width direction D2 and a plurality of stringer members 777 coupling the plurality of frame members 776 together.

In accordance with the present illustrative embodiment, each of the plurality of frame members 776 has a ring shape or an arc shape. The plurality of frame members 776 are spaced away from each other in the paper-width direction D2. The outer circumferential surface of each of the plurality of frame members 776 is in contact with the inner circumferential surface of the heating rotary belt 9*a* with the above-described lubricant and a low-friction sheet 77A, which is described below, being disposed therebetween.

As illustrated in FIG. 4, the plurality of frame members 776 include a first frame member 776A at the external end of the maximum-paper-passing-region corresponding region 771, a second frame member 776B at the external end of the first-intermediate-paper-passing-region corresponding region 772, a third frame member 776C at the external end of the second-intermediate-paper-passing-region corresponding region 773, and a fourth frame member 776D at the external end of the minimum-paper-passing-region corresponding region 774.

As illustrated in FIG. 5, each of the first frame member 776A and the second frame member 776B is a circular ring-shaped member having a substantially circular hole in its substantially central portion. The third frame member 776C has the shape of an arc whose size is approximately two-thirds of the size of the circle of each of the first frame member 776A and the second frame member 776B. The fourth frame member 776D has the shape of an arc whose Size is approximately one-third of the size of the circle of each of the first frame member 776A and the second frame member 776B. For the sake of clarity of the description, the low-friction sheet 77A, which is described below, is not illustrated in FIG. 5.

The plurality of stringer members 777 are bar members having a straight-line shape that is long in the paper-width direction D2. The plurality of stringer members 777 couple the plurality of frame members 776 together and are in contact with the inner circumferential surface of the heating rotary belt 9*a* with the above-described lubricant and the low-friction sheet 77A, which is described below, disposed therebetween. The plurality of stringer members 777 include a first stringer member 777A, a second stringer member 777B, and a third stringer member 777C.

The first stringer member 777A couples the first frame member 776A, the second frame member 776B, the third frame member 776C, and the fourth frame member 776D together.

The second stringer member 777B is spaced away from the location where the first stringer member 777A is arranged by approximately 120° in a rotation direction C1 of the movable guiding section 77 (counterclockwise in FIG. 5) about the movable rotation axis J2. The second stringer member 777B couples the first frame member 776A, the second frame member 776B, the third frame member 776C, and the fourth frame member 776D together.

The third stringer member 777C is spaced away from the location where the second stringer member 777B is arranged by approximately 120° in the rotation direction C1 of the movable guiding section 77 (counterclockwise in FIG. 5) about the movable rotation axis J2. The third stringer member 777C couples the first frame member 776A, the second frame member 776B, and the third frame member 776C together.

The plurality of frame members 776 and the plurality of stringer members 777 form a plurality of loop sections 778. The plurality of loop sections 778 correspond to a plurality of paper unpassing regions in association with the sizes of the paper T. Regions surrounded by the plurality of loop sections 778 are a plurality of loop regions 779 as blocking sections.

Specifically, the plurality of loop sections 778 include a first loop section 778A, a second loop section 778B, and a third loop section 778C.

The first loop section 778A corresponds to the paper T having the minimum paper passing width W4 and is disposed in a region outside the minimum-paper-passing-region corresponding region 774. The region surrounded by the first loop section 778A is a first loop region 779A as the blocking section. The first loop region 779A is disposed on the circumferential surface of the movable guiding section 77.

The second loop section 778B corresponds to the paper T having the second intermediate paper passing width W3 and is disposed in a region outside the second-intermediate-paper-passing-region corresponding region 773. The region surrounded by the second loop section 778B is a second loop region 779B as the blocking section. The second loop region 779B is disposed on the circumferential surface of the movable guiding section 77.

The third loop section 778C corresponds to the paper T having the first intermediate paper passing width W2 and is disposed in a region outside the first-intermediate-paper-passing-region corresponding region 772. The region surrounded by the third loop section 778C is a third loop region 779C as the blocking section. The third loop region 779C is disposed on the circumferential surface of the movable guiding section 77.

An induced current that is made to flow in each of the loop sections 778 by a penetrating magnetic flux substantially perpendicular to an imaginary curved surface of each of the loop regions 779 makes the movable guiding section 77 generate magnetic flux having the opposite direction to that of the penetrating magnetic flux. The movable guiding section 77 reduces or blocks the magnetic flux that passes along the magnetic path by generating magnetic flux in a direction in which linkage magnetic flux (substantially perpendicular penetrating magnetic flux) is cancelled. The blocking frame bodies 775 of the movable guiding section 77 is made of a nonmagnetic member that has high conductivity, and oxygen free copper can be used for the blocking frame bodies 775, for example.

As illustrated in FIG. 4, the movable guiding section 77 is rotatable about the movable rotation axis J2 such that it can be positioned in the first blocking position (see FIG. 7B), where any one of the loop regions 779 faces the first facing surface 731 of the central core section 73 and the magnetic flux generated by the induction coil 71 is reduced or blocked, and in the first non-blocking position (see FIG. 7A), where any loop regions 779 do not face the first facing surface 731 of the central core section 73 and the magnetic flux generated by the induction coil 71 is not reduced or blocked.

Here, rotation positions of the movable guiding section 77 are described in connection with their function and the operation of the fixing device 9 in accordance with some embodiments. For the present embodiment, the movable guiding section 77 is rotatable so as to be positioned one selected among a first rotation position to a sixth rotation position, as illustrated in FIGS. 6A to 6F. For the sake of clarity of the description, the low-friction sheet 77A, which is described below, is not illustrated in FIGS. 6A to 6F.

First, the first rotation position (see FIG. 6A), the third rotation position (see FIG. 6C), and the fifth rotation position (see FIG. 6E) of the movable guiding section 77 are described. The first rotation position, the third rotation position, and the fifth rotation position are the positions at which the first facing surface 731 of the central core section 73 faces the third stringer member 777C, the first stringer member 777A, and the second stringer member 777B, respectively.

In the first rotation position, third rotation position, and fifth rotation position of the movable guiding section 77, as illustrated in FIG. 7A, at the upstream and downstream sides in the conveyance direction D1 of the paper T, the magnetic flux penetrating the substrate of the heating rotary belt 9*a* passes through the corresponding loop region 779 in a magnetic-path circling direction R3B and then returns in the same loop region 779 from the opposite direction and passes through it again. That is, the magnetic flux passes through the same loop region 779 bi-directionally, and the total of the penetrating magnetic flux is substantially zero.

Therefore, no induced current occurs in the loop sections 778. The loop section 778 does not cancel the magnetic flux generated by the induction coil 71, and the magnetic flux generated by the induction coil 71 is not reduced or blocked. Accordingly, the heating rotary belt 9*a* can be subjected to induction heating in the maximum paper passing region 901 in association with the paper T of the maximum paper passing width W1 in the first rotation position (see FIG. 6A), the third rotation position (see FIG. 6C), and the fifth rotation position (see FIG. 6E).

Next, the second rotation position (see FIG. 6B), the fourth rotation position (see FIG. 6D), and the sixth rotation position (see FIG. 6F) of the movable guiding section 77 are described. When the movable guiding section 77 is positioned in the second rotation position, the fourth rotation position, and the sixth rotation position, the movable guiding section 77 reduces or blocks the magnetic flux in paper unpassing regions in association with the paper T of the first intermediate paper passing width W2 (e.g., portrait B4-size paper T), the paper T of the minimum paper passing width W4 (e.g., portrait A5-size paper T), and the paper T of the second intermediate paper passing width W3 (e.g., portrait A4-size paper T), respectively.

When the movable guiding section 77 is positioned in the second rotation position, the fourth rotation position, and the sixth rotation position, as illustrated in FIGS. 6B, 6D, and 6F, the first facing surface 731 of the central core section 73 faces the third loop region 779C, the first loop region 779A, and the second loop section 779B, respectively.

In the second rotation position, the fourth rotation position, and the sixth rotation position of the movable guiding section 77, as illustrated in FIG. 7B, at the upstream and downstream sides in the conveyance direction D1 of the paper T, magnetic flux penetrating the substrate of the heating rotary belt 9*a* passes through the corresponding loop region 779 in one direction. This causes an induced current to flow along the loop section 778.

Electromagnetic induction caused by the induced current generates magnetic flux in the opposite direction to the penetrating magnetic flux. Accordingly, the movable guiding section 77 reduces or blocks the magnetic flux passing along the magnetic path by generating the magnetic flux in a direction in which the linkage magnetic flux (substantially perpendicular penetrating magnetic flux) is cancelled.

Here, in accordance with the present illustrative embodiment, the configuration in which the magnetic flux generated by the induction coil 71 passes through the loop region 779 in one direction and thus an induced current can be made to flow along the loop section 778 requires the loop region 779 to face the first facing surface 731 of the central core section 73 and also requires the stringer member 777 to be more adjacent to the central core section 73 with respect to the location where the movable guiding section 77 would face the second facing surface 761 of the side core section 76.

In such a way, in the second rotation position (see FIG. 6B), the fourth rotation position (see FIG. 6D), and the sixth rotation position (see FIG. 6F), the movable guiding section 77 reduces or blocks the magnetic flux in paper unpassing regions in association with the paper T of the first intermediate paper passing width W2, the paper T of the minimum paper passing width W4, and the paper T of the second intermediate paper passing width W3, respectively.

The movable guiding section 77 includes the low-friction sheet 77A as a first low-friction member. The low-friction sheet 77A is made of a material having a coefficient of friction lower than that of the blocking frame body 775 of the movable guiding section 77 and also has a heat insulation property. The low-friction sheet 77A is disposed in a portion of the outer circumferential surface of the movable guiding section 77 that is in contact with the inner circumferential surface of the heating rotary belt 9*a*.

The low-friction sheet 77A is made of a heat-resistant material that has a heat insulation property higher than that of the blocking frame body 775 of the movable guiding section 77. The material of the low-friction sheet 77A has thermal conductivity lower than that of the blocking frame body 775 of the movable guiding section 77. The low-friction sheet 77A may preferably be thin (e.g., approximately 0.2 mm in thickness). For the present embodiment, the low-friction sheet 77A is a glass cloth sheet made of glass fiber containing PTFE.

As illustrated in FIG. 4, the movable guiding section 77 is integrally rotated by driving of a support rotating plate 153 fixed at the end of the movable guiding section 77 by a movable guiding rotation section 155. The movable guiding rotation section 155 includes a rotation driving section 158.

The movable guiding rotation section 155 refers to information stored in a storage section (not illustrated) in response to size information indicating the size of the paper T received by the printer 1 and controls the rotation driving section 158 by the use of a movable guiding rotation control section (not illustrated). The storage section can store a rotation angle from a reference position of the movable guiding section 77 associated with the size information on the paper T. In response to the paper size (paper width), the magnetic flux that passes along the magnetic path in the paper unpassing region of the paper T is reduced or blocked.

The temperature sensor 95 detects a temperature of the outer circumferential surface of the heating rotary belt 9*a*. The temperature sensor 95 faces the outer circumferential surface of the heating rotary belt 9*a* and is not in contact therewith.

Next, operations of the printer 1 including the fixing device 9 of the present embodiment are described. First, a reception section (not illustrated) of the printer 1 receives image formation instructing information generated on the basis of, for example, an action on an operational section (not illustrated) outside the printer 1 when the power to the printer 1 is on.

In response to size information on the paper T received by the reception section, the movable guiding rotation control section positions the movable guiding section 77 at any one of the first rotation position to the sixth rotation position (see FIGS. 6A to 6F) by rotating the movable guiding section 77 or maintaining the rotational position of the movable guiding section 77 without rotating it. For example, in the case in which an instruction to perform printing on an intermediate-size paper T of the second intermediate paper passing width W3 (e.g., portrait A4-size paper T) is received, the movable guiding rotation control section refers to the storage section (not illustrated) and controls the movable guiding rotation section 155.

Accordingly, as illustrated in FIG. 6F, the movable guiding rotation control section positions the second loop region 779B at the first blocking position (see FIG. 7B) associated with the paper unpassing region of the paper T of the second intermediate paper passing width W3 (e.g., portrait A4-size paper T).

Then, the printer 1 starts a printing operation. When supplying power to a driving control section (not illustrated) starts, the pressing roller 9*b* is rotated by the rotation driving section (not illustrated). The rotation of the pressing roller 9*b* is followed by the heating rotary belt 9*a*, and the heating rotary belt 9*a* is thus rotated.

Next, the fixing device 9 starts a heat generating operation. An alternating current is applied from the induction heating circuit section (not illustrated) to the induction coil 71. The induction coil 71 generates magnetic flux for causing the heating rotary belt 9*a* to generate heat.

Part of the magnetic flux generated by the induction coil 71 penetrates the substrate of the heating rotary belt 9*a* and is guided to the inner core section 78, whereas another part of the magnetic flux does not penetrate the substrate of the heating rotary belt 9*a* and is guided along the heating rotary belt 9*a*. The part of the magnetic flux guided along the substrate of the heating rotary belt 9*a* and that guided to the inner core section 78 pass through the substrate of the heating rotary belt 9*a* and the inner core section 78, respectively, and both meet in the side core section 76.

A change in the magnitude and direction of the magnetic flux that passes along the magnetic path causes an eddy current (induced current) by electromagnetic induction to occur in the upper portion of the substrate of the heating rotary belt 9*a* in the vertical direction. In response to the eddy current, Joule heat is generated in the substrate of the heating rotary belt 9*a* due to the electrical resistance of the substrate of the heating rotary belt 9*a*.

As illustrated in FIG. 7B, in the paper unpassing region in association with each of the sizes of the paper T, the magnetic flux generated by the induction coil 71 and penetrating the substrate of the heating rotary belt 9*a* passes through the loop region 779 of the movable guiding section 77 in the inner path R3B. This leads the movable guiding section 77 to generate magnetic flux in the opposite direction to penetrating magnetic flux substantially perpendicular to an imaginary curved surface of the loop region 779 by the action of an induced current caused by the penetrating magnetic flux and flowing in the loop section 778.

The movable guiding section 77 reduces or blocks the magnetic flux passing along the magnetic path by generating the magnetic flux in a direction in which linkage magnetic flux (substantially perpendicular penetrating magnetic flux) is cancelled. Accordingly, in the inner path R3B, the magnetic flux passing in the inner core section 78 is reduced or blocked.

The amount of the magnetic flux passing along the inner path R3B of the movable guiding section 77 is smaller than that in the case in which the movable guiding section 77 does not generate the magnetic flux in the opposite direction to the penetrating magnetic flux. The magnetic flux passing through the inner core section 78 reduced or blocked by the movable guiding section 77 meets the magnetic flux which does not penetrate the heating rotary belt 9*a* in the side core section 76. Thus, the amount of the magnetic flux passing through the side core section 76 and the heating rotary belt 9*a* in the paper unpassing region of the paper T in the case in which the movable guiding section 77 is in the first blocking position is smaller than that in the case in which the movable guiding section 77 is in the first non-blocking position.

Next, a portion of the heating rotary belt 9*a* that is made to generate heat due to induction heating is sequentially moved toward the fixing nip F formed between the heating rotary belt 9*a* and the pressing roller 9*b* of the fixing device 9 by the rotation of the heating rotary belt 9*a*. The fixing device 9 controls the induction heating circuit section (not illustrated) such that the fixing nip F has a predetermined temperature.

The paper T on which a toner image is formed is introduced to the fixing nip F of the fixing device 9. The toner is fused and fixed on the paper T at the fixing nip F.

In view of the foregoing description of an illustrative embodiment, it is understood that the fixing device 9 of the present embodiment reduces or blocks the magnetic flux generated by the induction coil 71 in the paper unpassing region in response to each of the sizes of the paper T. Accordingly, an excessive temperature rise in the paper unpassing region of the heating rotary belt 9*a* can be reduced.

Here, the movable guiding section 77 is in contact with the inner circumferential surface of the heating rotary belt 9*a* adjacent to the central core section 73. Therefore, the movable guiding section 77 guides the rotation of the heating rotary belt 9*a* so as to maintain the rotation path of the heating rotary belt 9*a*. Accordingly, the movable guiding section 77 can stabilize the rotation of the heating rotary belt 9*a*.

In addition, the movable guiding section 77 positions the upper portion of the heating rotary belt 9*a* in the vertical direction by being in contact with the inner circumferential surface of the heating rotary belt 9*a*. Accordingly, the magnetic flux that passes through the heating rotary belt 9*a* can be stabilized, and heat generation in the heating rotary belt 9*a* can be stabilized.

In this way, the movable guiding section 77 has the function of positioning the heating rotary belt 9*a* and guiding the rotation of the heating rotary belt 9*a* and the function of reducing or blocking the magnetic flux in the paper unpassing region in association with each of the sizes of the paper T. Accordingly, an increase in the size of the fixing device 9 can be suppressed.

The movable guiding section 77 includes the substantially cylindrical frame bodies. Accordingly, the thermal capacity of the fixing device 9 can be reduced. This can shorten the warm-up time, thus resulting in a reduction in power consumption.

The movable guiding section 77 has the low-friction sheet 77A in the portion being in contact with the inner circumferential surface of the heating rotary belt 9*a*. Accordingly, friction resistance between the heating rotary belt 9*a* and the movable guiding section 77 can be reduced, thus enabling the heating rotary belt 9*a* to satisfactorily slide. In addition, because the inner circumferential surface of the heating rotary belt 9*a* has grease as the lubricant applied thereon, more satisfactory sliding between the heating rotary belt 9*a* and the movable guiding section 77 can be achieved.

The low-friction sheet 77A has a heat insulation property. Accordingly, heat transmission between the movable guiding section 77 and the heating rotary belt 9*a* can be reduced. This leads to a reduction in the thermal capacity of the fixing device 9.

The low-friction sheet 77A is thin. Accordingly, the inner core section 78 is arranged in the vicinity of the central core section 73 and the side core section 76. This leads to an increase in the degree of coupling of magnetic fields (magnetic flux) between the inner core section 78 and each of the central core section 73 and the side core section 76, thus enabling the heating rotary belt 9*a* to efficiently generate heat.

With the printer 1 of the present embodiment, example advantageous effects are obtainable as mentioned below.

In the printer 1 of the present embodiment, the heating rotary belt 9*a* includes the substrate (magnetic metal layer) thinner than the magnetic-field penetration depth. Accordingly, the magnetic flux generated by the induction coil 71 is split into magnetic flux that penetrates the substrate of the heating rotary belt 9*a* and reaches the inside of the substrate of the heating rotary belt 9*a* and magnetic flux that does not penetrate the substrate of the heating rotary belt 9*a* and passes through the substrate of the heating rotary belt 9*a*. Thus, the movable guiding section 77 can reduce or block the magnetic flux in the paper unpassing region associated with each of the sizes of the paper T. Accordingly, an excessive temperature rise in the paper unpassing region of the heating rotary belt 9*a* in association with the paper T can be suppressed.

The movable guiding section 77 has the function of positioning the heating rotary belt 9*a* and guiding the rotation of the heating rotary belt 9*a* and the function of reducing or blocking the magnetic flux in the paper unpassing region associated with each of the sizes of the paper T. This can eliminate the need to arrange a member for reducing or blocking the magnetic flux in the paper unpassing region associated with each of the sizes of the paper T outside the heating rotary belt 9*a*. Accordingly, an increase in the size of the fixing device 9 can be suppressed.

The movable guiding section 77 includes the substantially cylindrical frame bodies. Accordingly, the thermal capacity of the fixing device 9 can be reduced. This can shorten the warm-up time, thus resulting in a reduction in power consumption.

The heating rotary belt 9*a* is a belt that has low thermal capacity. Accordingly, the thermal capacity of the fixing device 9 can be reduced, as in the case of the movable guiding section 77.

The movable guiding section 77 positions the heating rotary belt 9*a* and also guides the rotation of the heating rotary belt 9*a*. Accordingly, the rotation of the heating rotary belt 9*a* can be stabilized. Thus, the magnetic flux that passes through the heating rotary belt 9*a* can be stabilized, and heat generation in the heating rotary belt 9*a* can be stabilized.

In the printer 1 of the present embodiment, the plurality of loop regions 779 are surrounded by the plurality of frame members 776 and the plurality of stringer members 777. Accordingly, the plurality of loop regions 779 can be simply configured. Thus, with the simple configuration, magnetic the flux in the paper unpassing region associated with each of the sizes of the paper T can be reduced or blocked.

In the printer 1 of the present embodiment, the inner core section 78 forms the magnetic path in the paper passing region. Accordingly, the inner core section 78 guides the magnetic flux that passes inside the heating rotary belt 9*a*, concentrates the magnetic flux, and makes a strong magnetic field. Thus, the heating rotary belt 9*a* can be made to efficiently generate heat.

Because the inner core section 78 is not in contact with the movable guiding section 77, heat transmission between the movable guiding section 77 and the inner core section 78 can be reduced. Accordingly, the thermal capacity of the fixing device 9 can be reduced.

The strength of the magnetic flux passing through the heating rotary belt 9*a* can be varied by the use of the movable guiding section 77 between the case in which the magnetic flux passing through the inner core section 78 is blocked and the case in which it is not blocked. Thereby, the amount of heat generation in the heating rotary belt 9*a* can be efficiently controlled in both the paper passing region and the paper unpassing region.

In the printer 1 of the present embodiment, the movable guiding section 77 includes the low-friction sheet 77A having a low coefficient of friction. Accordingly, sliding between the heating rotary belt 9*a* and the movable guiding section 77 is improved.

In the printer 1 of the present embodiment, the low-friction sheet 77A has a heat insulation property. Accordingly, since the thermal capacity of the heating rotary belt 9*a* is maintained low, a reducing in the thermal capacity of the fixing device 9 is achieved.

In the printer 1 of the present embodiment, the inner circumferential surface of the heating rotary belt 9*a* has the lubricant applied thereon that has a coefficient of friction lower than that of the substrate of the heating rotary belt 9*a*. Accordingly, sliding of the heating rotary belt 9*a* can be more improved.

In the printer 1 of the present embodiment, positioning the movable guiding section 77 at the first blocking position associated with the paper unpassing region associated with each of the sizes of the paper T enables suppressing an excessive temperature rise in the paper unpassing region of the heating rotary belt 9*a*.

An example of embodiments of the present disclosure is described above. The present disclosure is not limited to the above-described embodiment, and various forms, variations, or alternative embodiments can be made in view of the present disclosure.

For example, in the above-described embodiment, the magnetic core section 72 includes the central core section 73, the plurality of pairs of arch core sections 74, and the pair of side core sections 76. However, other configurations may be used. For example, the magnetic core section 72 may include none of the central core section 73, the plurality of pairs of arch core sections 74, and the pair of side core sections 76, may include any one of them, or alternatively, any two of them.

For example, in the above-described embodiment, the movable guiding section 77 is rotatable so as to be able to be positioned in the first blocking position, where one or more loop regions 779 face the first facing surface 731 of the central core section 73 and the magnetic flux is reduced or blocked, and in the first non-blocking position, where one or more loop regions 779 do not face the first facing surface 731 of the central core section 73 and the magnetic flux is not reduced or blocked. In addition, the movable guiding section 77 may be rotatable so as to be able to be positioned in a second blocking position where one or more loop regions 779 faces the second facing surface 761 of the side core section 76 and the magnetic flux is reduced or blocked and in a second non-blocking position where one or more loop regions 779 do not face the second facing surface 761 of the side core section 76 and the magnetic flux is not reduced or blocked.

In the above-described embodiment, the heating rotary belt 9*a* is principally composed of magnetic metal. However, any other material may also be used. The heating rotary belt 9*a* may be principally composed of non-magnetic metal. In the case in which the heating rotary belt 9*a* is principally composed of non-magnetic metal, all of the magnetic flux generated by the induction coil 71 penetrates the heating rotary belt 9*a*. The heating rotary belt 9*a* can generate heat by induction heating in the non-magnetic metal in the portion penetrated by the magnetic flux.

In the above-described embodiment, the low-friction sheet 77A as the first low-friction member is made of a glass cloth sheet. However, any other materials may also be used. For example, the low-friction sheet 77A can be made of a PFA tube or members such as a rib member made of heat-resistant resin which can have less contact area with the heating rotary belt 9*a* to reduce friction between the heating rotary belt 9*a* and movable guiding section 77 (the low-friction sheet 77A).

In the above-described embodiment, the lubricant is used as the second low-friction member. However, any other elements may also be used. For example, the second low-friction member may be made of a sheet having a coefficient of friction lower than that of the substrate of the heating rotary belt 9*a*.

The image forming apparatus of the present disclosure is not limited to a particular type. Examples of the image forming apparatus can include, in addition to the printer, a copier, a facsimile machine, and a multi-functional peripheral that functions as them.

A sheet material that allows an image to be transferred thereto is not limited to paper. For example, a film sheet may also be used.

Having thus described in detail embodiments of the present disclosure, it is to be understood that the subject matter disclosed by the foregoing paragraphs is not to be limited to particular details and/or embodiments set forth in the above description, as many apparent variations thereof are possible without departing from the spirit or scope of the present disclosure.

What is claimed is:

1. A fixing device comprising:

an induction coil that is operable to generate magnetic flux;

a heating rotary belt that is arranged in a region in which the magnetic flux generated by the induction coil passes and that includes a heat generating layer thinner than a magnetic-field penetration depth;

a pressure receiving member arranged inside the heating rotary belt and being in contact with an inner surface of the heating rotary belt;

a pressing rotator facing the heating rotary belt;

a fixing nip formed between the pressing rotator and the heating rotary belt that is sandwiched between the pressure receiving member and the pressing rotator, the fixing nip being configured to pinch and convey a recording medium;

a magnetic core section configured to form a circulating magnetic path that surrounds the induction coil; and a movable guiding section arranged inside the heating rotary belt, the movable guiding section being in contact with the inner surface of the heating rotary belt, being a substantially cylindrical frame body, configured to guide a rotation of the heating rotary belt, including one or more blocking sections, and being rotatable so as to be able to be positioned in a first blocking position where the one or more blocking sections reduce or substantially block the magnetic flux and in a first non-blocking position where the one or more blocking sections do not reduce or substantially block the magnetic flux, wherein the frame body includes:

a plurality of frame members each having a ring shape or an arc shape; and a plurality of stringer members each having a bar shape configured to form a plurality of loop sections with the frame members;

wherein the blocking sections includes a plurality of loop regions surrounded by the loop sections;

wherein when the movable guide section is positioned in the first blocking position, at least one of the loop regions is configured to face a portion of the magnetic core, a magnetic flux having an opposite direction to that of a penetrating magnetic flux through the loop section, and the blocking sections reduce or substantially block the magnetic flux; and wherein when the movable guide section is positioned in the first non-blocking position, the loop regions are not configured to face the portion of the magnetic core, and the blocking sections do not reduce or substantially block the magnetic flux.

2. The fixing device according to claim 1, wherein the magnetic core section includes one or more first core sections facing an outer surface of the heating rotary belt with the induction coil interposed therebetween.

3. The fixing device according to claim 1, wherein the magnetic core section includes a second core section adjacent to an inner edge of the induction coil, the second core section including a first facing surface that faces an outer surface of the heating rotary belt without the induction coil interposed therebetween.

4. The fixing device according to claim 1, wherein the magnetic core section includes a third core section adjacent to an outer edge of the induction coil, the third core section including a second facing surface that faces an outer surface of the heating rotary belt without the induction coil interposed therebetween.

5. The fixing device according to claim 1, wherein the plurality of frame member being spaced away from each other in a direction substantially perpendicular to a rotation direction of the heating rotary belt and being in contact with the inner surface of the heating rotary belt; and wherein the plurality of stringer members each having the bar shape that is elongated in the direction substantially perpendicular to the rotation direction of the heating rotary belt, the plurality of stringer members coupling the plurality of frame members and being in contact with the inner surface of the heating rotary belt.

6. The fixing device according to claim 1, wherein the movable guiding section has an inner empty space, the magnetic core section includes a fourth core section arranged in the inner empty space of the movable guiding section, and the fourth core section is not in contact with the movable guiding section.

7. The fixing device according to claim 1, wherein the movable guiding section includes a first low-friction member in a portion being in contact with the inner surface of the heating rotary belt, and the first low-friction member has a coefficient of friction lower than that of the frame body of the movable guiding section.

8. The fixing device according to claim 7, wherein the first low-friction member has a heat insulation property.

9. An image forming apparatus comprising:

an image bearing member including a surface that allows an electrostatic latent image to be formed thereon;

a developing device that is operable to develop the electrostatic latent image formed on the image bearing member as a toner image;

a transfer section that is operable to transfer the toner image formed on the image bearing member to a recording medium; and a fixing device that is operable to fix the toner image transferred to the recording medium, wherein the fixing device includes:

an induction coil that is operable to generate magnetic flux;

a heating rotary belt that is arranged in a region in which the magnetic flux generated by the induction coil passes and that includes a heat generating layer thinner than a magnetic-field penetration depth;

a pressure receiving member arranged inside the heating rotary belt and being in contact with an inner surface of the heating rotary belt;

a pressing rotator facing the heating rotary belt;

a fixing nip formed between the pressing rotator and the heating rotary belt that is sandwiched between the pressure receiving member and the pressing rotator, the fixing nip being configured to pinch and convey a recording medium;

a magnetic core section configured to form a circulating magnetic path that surrounds the induction coil; and a movable guiding section arranged inside the heating rotary belt, the movable guiding section being in contact with the inner surface of the heating rotary belt, being a substantially cylindrical frame body, configured to guide a rotation of the heating rotary belt, including one or more blocking sections, and being rotatable so as to be able to be positioned in a first blocking position where the one or more blocking sections reduce or substantially block the magnetic flux and in a first non-blocking position where the one or more blocking sections do not reduce or substantially block the magnetic flux, wherein the frame body includes:

a plurality of frame members each having a ring shape or an arc shape; and a plurality of stringer members each having a bar shape configured to form a plurality of loop sections with the frame members;

wherein the blocking sections includes a plurality of loop regions surrounded by the loop sections;

wherein when the movable guide section is positioned in the first blocking position, at least one of the loop regions is configured to face a portion of the magnetic core, a magnetic flux having an opposite direction to that of a penetrating magnetic flux through the loop section, and the blocking sections reduce or substantially block the magnetic flux; and wherein when the movable guide section is positioned in the first non-blocking position, the loop regions are not configured to face the portion of the magnetic core, and the blocking sections do not reduce or substantially block the magnetic flux.

10. The image forming apparatus according to claim 9, wherein the magnetic core section includes one or more first core sections facing an outer surface of the heating rotary belt with the induction coil interposed therebetween.

11. The image forming apparatus according to claim 9, wherein the magnetic core section includes a second core section adjacent to an inner edge of the induction coil, the second core section including a first facing surface that faces an outer surface of the heating rotary belt without the induction coil interposed therebetween.

12. The image forming apparatus according to claim 9, wherein the magnetic core section includes a third core section adjacent to an outer edge of the induction coil, the third core section including a second facing surface that faces an outer surface of the heating rotary belt without the induction coil interposed therebetween.

13. The image forming apparatus according to claim 9, wherein the plurality of frame member being spaced away from each other in a direction substantially perpendicular to a rotation direction of the heating rotary belt and being in contact with the inner surface of the heating rotary belt; and wherein the plurality of stringer members each having the bar shape that is elongated in the direction substantially perpendicular to the rotation direction of the heating rotary belt, the plurality of stringer members coupling the plurality of frame members and being in contact with the inner surface of the heating rotary belt.

14. The image forming apparatus according to claim 9, wherein the movable guiding section has an inner empty space, the magnetic core section includes a fourth core section arranged in the inner empty space of the movable guiding section, and the fourth core section is not in contact with the movable guiding section.

15. The image forming apparatus according to claim 9, wherein the movable guiding section includes a first low-friction member in a portion being in contact with the inner surface of the heating rotary belt, and the first low-friction member has a coefficient of friction lower than that of the frame body of the movable guiding section.

16. The image forming apparatus according to claim 15, wherein the first low-friction member has a heat insulation property.

17. The fixing device according to claim 6, wherein the fourth core section has a substantially cylindrical shape, is arranged along with the second core section and the third core section, and forms a magnetic path between the second core section and the third core section.

18. The fixing device according to claim 7, wherein a second low-friction member is applied on the inner circumferential surface of the heating rotary belt.

19. The fixing device according to claim 6, wherein the movable guiding section is configured to be rotatable so as to be able to be positioned in a second blocking position where at least one of the loop regions faces the second facing surface of the third core section and the magnetic flux is reduced or blocked and in a second non-blocking position where the loop regions do not face the second facing surface of the third core section and the magnetic flux is not reduced or blocked.

* * * * *